United States Patent [19]

Arai et al.

[11] 4,404,274

[45] Sep. 13, 1983

[54] PHOTOGRAPHIC LIGHT SENSITIVE ELEMENT CONTAINING YELLOW COLOR COUPLER AND METHOD FOR FORMING YELLOW PHOTOGRAPHIC IMAGES

[75] Inventors: Atsuaki Arai; Yasushi Oishi; Akio Okumura; Kiyoshi Nakazyo, all of Minami-ashigara, Japan

[73] Assignee: Fuji Photo Film Co., Ltd., Kanagawa, Japan

[21] Appl. No.: 251,561

[22] Filed: Apr. 6, 1981

Related U.S. Application Data

[63] Continuation of Ser. No. 235,937, Mar. 20, 1972, abandoned.

[30] Foreign Application Priority Data

Mar. 20, 1971 [JP] Japan ..... 46-15997

[51] Int. Cl.[3] ..... G03C 7/00; G03C 1/40

[52] U.S. Cl. ..... 430/389; 430/393; 430/472; 430/475; 430/557; 430/558

[58] Field of Search ..... 430/393, 389, 472, 475, 430/557, 558

[56] References Cited

U.S. PATENT DOCUMENTS

| | | | |
|---|---|---|---|
| 3,328,419 | 6/1967 | Anderson | 430/543 |
| 3,582,322 | 6/1971 | Edens et al. | 430/383 |
| 3,615,508 | 10/1971 | Stephen et al. | 430/393 |
| 3,615,603 | 10/1971 | Iwama et al. | 430/556 |
| 3,730,722 | 5/1973 | Inoue et al. | 430/557 |
| 3,738,840 | 6/1973 | Anderson | 430/552 |
| 3,973,968 | 8/1976 | Fujiwhara et al. | 430/389 |
| 4,057,432 | 11/1977 | Fujiwhara et al. | 430/389 |

*Primary Examiner*—J. Travis Brown

*Attorney, Agent, or Firm*—Sughrue, Mion, Zinn, Macpeak and Seas

[57] ABSTRACT

A photographic light-sensitive element comprising a support and having thereon at least one silver halide emulsion layer containing an α-diacylamino substituted (aliphatic acyl) acetamide yellow dye forming coupler and a method for forming yellow dye images which comprises processing a silver halide photographic emulsion with an aromatic primary amino developing agent in the presence of an α-diacylamino substituted (aliphatic acyl) acetamide compound are disclosed. The coupler is an excellent two-equivalent coupler.

47 Claims, 1 Drawing Figure

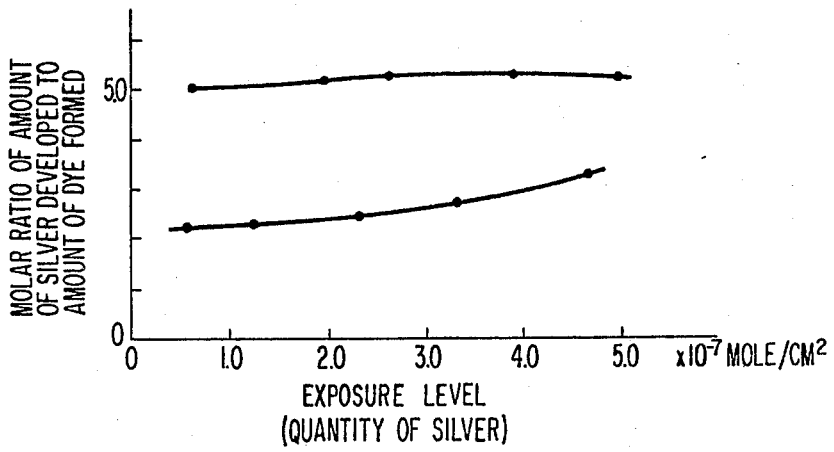
MOLAR RATIO OF AMOUNT OF SILVER DEVELOPED TO AMOUNT OF DYE FORMED
5.0
0
0
1.0
2.0
3.0
4.0
5.0
x10⁻⁷ MOLE/CM²
EXPOSURE LEVEL
(QUANTITY OF SILVER)

PHOTOGRAPHIC LIGHT SENSITIVE ELEMENT CONTAINING YELLOW COLOR COUPLER AND METHOD FOR FORMING YELLOW PHOTOGRAPHIC IMAGES

This is a continuation of application Ser. No. 235,937, filed Mar. 20, 1972, now abandoned.

BACKGROUND OF THE INVENTION

1. Field of the Invention

The present invention relates generally to a photographic element and a method for the formation of color photographic images, and more particularly to a photographic element and a method for the formation of color photographic images wherein a novel yellow-forming coupler is used.

2. Description of the Prior Art

In the formation of colored images in color photography by a substractive color reproduction process, an aromatic primary amino compound, especially a N,N-disubstituted-para-diphenylene-diamino compound, is used as a developing agent, to reduce the silver halide grains in an exposed photographic emulsion, and the concurrently produced oxidation product of the developing agent is coupled with the coupler to form the image dye of the primary colors cyan, magenta or yellow.

The couplers for use in the above-described developing process have a phenolic hydroxyl group, an anilinic amino group or an active methylene group, and, by coupling with the oxidation product of the aromatic primary amino developing agent, form dyes which absorb light in the visible wave length range.

The yellow dye images show a specific absorption spectrum to a blue light in the wave length ranging from about 400 to 500 millimicrons. Previously known yellow-forming color couplers include $\beta$-ketoacetoacetic esters, $\beta$-diketones, N,N-malonic diamides and $\alpha$-acylacetoamides, among which the $\alpha$-acylacetoamides have been widely used to advantage in the field of color photography.

The $\alpha$-acylacetoamides as couplers and the yellow dyes derived therefrom as images have, however, a number of disadvantages and are by no means completely satisfactory. For example, conversion of the $\alpha$-acylacetoamides to the azomethine dyes requires 4 equivalents of silver halide as the oxidizing agent, per molecule, and, moreover, the maximum molecular extinction coefficient of the dyes formed is only on the order of about 20, 000 l. mol./cm. This means that an excessively large amount of silver halide is required to obtain the level of absorbance to blue light necessary in color photography. Furthermore, the incorporation of a large amount of silver halide into light-sensitive materials leads to some technical difficulties, such as an increase of light scattering in the emulsion and consequently, a decrease in the definition of the photographic images.

Furthermore, the $\alpha$-acylacetoamides which give clear yellow dye images, generally have poor coupling reactivity with the oxidation product of the aromatic primary amino color developing agent so that a sufficient amount of dye does not result and this poor reactivity reduces the speed at which the developing process of the silver halide emulsion can be conducted, thereby making it difficult to carry out rapid development processing.

Moreover, the yellow dye images derived from the $\alpha$-acylacetoamides lack sufficient resistance to light and humidity and thereby undergo deterioration in color when stored for a long period under severe conditions. This poor resistance of the yellow dye images consitutes one of the primary difficulties in storage of color photographs for long period.

In an attempt to eliminate the foregoing faults, a variety of inventions has been proposed.

For example, the specification of U.S. Pat. No. 3,265,506 discloses the derivatives of $\alpha$-acylacetoanilide in which the carbonyl group of the acyl group is attached directly to the tertiary carbon atom of the alkyl group. It is true that dye images of derivatives of this class have both an excellent fastness and spectral absorption performance suitable for the color-reproduction by a substractive color photographic process, but a number of disadvantages concurrently accompany use of these derivatives. That is, these derivatives generally are poor in their oxidative coupling reactivity, and therefore, are unable to give yellow images having a high absorbance, and, the formation of the dyes is not completed in the color developing bath, so that the derivatives have to be subjected to a further processing containing a stronger oxidizing agent. Furthermore, in an attempt to make up for these faults, some derivatives were disclosed in which a hydrogen atom of the active methylene group is substituted by a halogen atom such as a fluorine or a chlorine atom, a sulfonyloxy group (see U.S. Pat. No. 3,415,652), or an acyloxy group (see U.S. Pat. No. 3,447,928). However, the replacement of a hydrogen atom in the active methylene group by such substituents is also accompanied by either of the following disadvantages. That is, coupling reactivity is not enhanced to a satisfactory extent, a marked color fog is produced, or the couplers, due to their own instability, gradually are changed into a condition in which they can no longer form a dye.

It is, therefore, an object of the present invention to provide a novel yellow-forming coupler suitable for use in color photography by a substractive color photographic process.

It is another object of the present invention to provide a method for the formation of dye images by effecting the development of a silver halide emulsion in the presence of a novel yellow-forming coupler.

It is another object of the present invention to provide color photographic light sensitive materials having a silver halide emulsion with a novel yellow-forming coupler incorporated therein.

It is another object of the present invention to provide a color developing composition containing a novel yellow-forming coupler.

It is yet another object of the present invention to provide a means for minimizing the amount of the silver halide contained in the photographic emulsion and improving the sharpness of the resulting images, with the use of a novel yellow-forming coupler.

It is another object of the present invention to provide a color photographic light-sensitive material suitable for rapid color development using a fix-bleaching bath containing both a weak oxidizing agent and a silver complex forming agent.

It is still another object of the present invention to provide yellow dye images having suitable spectral absorption characteristics for color reproduction by a substractive color photographic process, together with an excellent stability.

Other objects of the present invention will become apparent from the disclosure contained herein and the appended claims.

SUMMARY OF THE INVENTION

The foregoing objects are accomplished in accordance with the instant invention by providing a photographic element and a method for the formation of dye images where a silver halide photographic emulsion is processed using an aromatic primary amino developer in the presence of an (aliphatic acyl) acetoamide compound substituted in the α-position by a diacylamino group.

More particularly, the method according to the present invention involves processing a silver halide photographic emulsion with an aromatic primary amino developing agent, in the presence of a novel yellow-forming coupler having a diacylamino substituent in the α-position thereof which may be represented by the following General Formula (I)

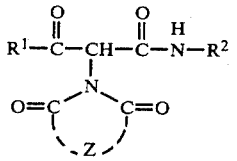

General Formula (I)

wherein $R^1$ is an alkyl group or an alkenyl group, $R^2$ is an aryl group or a heterocyclic group, and Z is the non-metallic atoms necessary to form, together with the

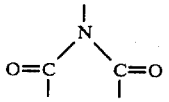

moiety in the formula, a 4-membered, a 5-membered or a 6-membered substituted or unsubstituted ring.

BRIEF DESCRIPTION OF THE ACCOMPANYING DRAWING

The accompanying drawing is a graphical representation of the molar ratio of developed silver to dye formed at varying exposure levels, in which a coupler of this invention was compared with a similar coupler but having no substitution at the coupling position, as described herein after in a comparative example.

DETAILED DESCRIPTION OF THE INVENTION

In the above-described General Formula (I), $R_1$ represents a substituted or unsubstituted alkyl group or a substituted or unsubstituted alkenyl group. The carbon atom located in the α-position may be either a primary, a secondary or a tertiary carbon atom. The term secondary carbon is intended to cover a carbon atom to which other two additional carbon atoms are directly attached or to which two additional carbon atoms are attached, directly and via an oxygen atom, respectively. The term tertiary carbon atom is intended to cover a carbon atom which has attached thereto three additional carbon atoms directly, or which has attached thereto two additional carbon atoms directly and another carbon atom via an oxygen atom. A tertiary alkyl group of from 4 to about 32 carbon atoms is suitable. The carbon atom in the β-position or located further from the β-position, relative to the carbonyl group, may be substituted to advantage by any suitable substituent. The number of the carbon atoms contained in the group $R^1$ preferably ranges from 1 to about 32, although this number will depend upon the kinds of other substituents $R^2$ and Z and/or upon the specific purpose for which the coupler is used. A preferred range for $R^1$ is from 1 to about 20 carbon atoms. The term alkyl as used herein is intended to cover straight chain alkyl, branched chain alkyl, cycloalkyl as well as substituted alkyl.

Suitable examples of such groups for the group $R^1$ include methyl, ethyl, n-propyl, isopropyl, n-butyl, isobutyl, tertbutyl, n-amyl, iso-amyl, tert-amyl, n-hexyl, 1-methylpentyl, 2-methylpentyl, 5-methylpentyl, neopentyl, 1,1-dimethylbutyl, n-heptyl, 1-methylhexyl, 2-methylhexyl, 3-methylhexyl, 5-methylhexyl, 1,1-dimethylhexyl, n-octyl, 2-ethylhexyl, 1,1-dimethylhexyl, n-nonyl, iso-nonyl, n-decyl, n-undecyl, n-dodecyl, n-tetradecyl, n-hexadecyl, n-octadeyl, 1,1-dimethylnonyldecyl, 1,1-di-n-amylhexyl-1-methyl-1-nonyldecyl, cyclopropyl, cyclobutyl, cyclopentyl, cyclohexyl, benzyl, phenethyl, allyl, oleyl, 7,7-dimethylnorbornyl, 1-methyl-cyclohexyl, p-tert-butylphenoxy-dimethyl-methyl, α-methoxyisopropyl, cholor-t-butyl, cinnamyl and 2-furyl groups.

The group $R^2$ represents an aryl group, such as a phenyl group or a substituted phenyl group. The substituents which may be present on the phenyl group include, in addition to the monovalent substituents hereinafter described, divalent moieties which are taken together with the phenyl nucleus to form a condensed ring system

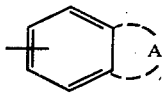

in which A represents the atoms necessary to form an aromatic condensed ring system. Such aryl group having a condensed ring system include naphthyl, quinolyl, iso-quinolyl, chromanyl and tetrahydronaphthyl groups. Furthermore, as a modified form of the General Formula (I), those derivatives in which two residual groups each of the same formula

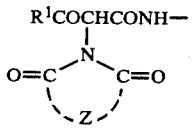

are bound either to only one phenylene group, directly combined with two phenyl groups or two phenyl groups combined via a bivalent group are suitable. In such cases the coupler may be represented by the following general formula

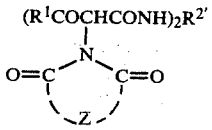

wherein $R^{2'}$ represents an arylene group. Suitable examples of such bivalent groups are as follows $-CH_2-$, $-O-$, $-NHCONH-$, and the like.

The monovalent substituents on the phenyl nucleus of the group $R^2$ which are suitable varies over a broad range of residual groups. Such substituents include, for example, halogen atoms, alkyl groups, alkenyl groups, alkoxy groups, aryl groups aryloxy groups, carbonyl groups, sulfonyl groups, carboxyl groups, alkoxycarbonyl groups, carbamyl groups, sulfone groups, sulfamyl groups, acylamino groups, ureido groups, sulfonamide groups, amino groups, nitro groups, cyano groups, and hydroxyl groups. The positions occupied by a hydrogen atom or atoms in these groups may be further substituted, i.e., a hydrogen atom or atoms replaced by a substituent giving rise to a substituted group. The phenyl nucleus of the group $R^2$ is preferably substituted by one or more of the above-described substituents. It is particularly preferred to use the compounds of the invention in which one of the ortho positions, relative to the residual group

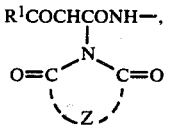

of the phenyl group ($R^2$) is substituted, for example, by a halogen atom, such as a fluorine, a chlorine or a bromine atom, an alkoxy group such as a methoxy, an ethoxy, a propoxy or an octoxy group, an aryloxy group such as a phenoxy or a tolyloxy group, an alkyl group such as a methyl or an ethyl group, or an amino group such as an N,N-dimethylamino or an N-n-butyl-N-n-octylamino group. The meta-, para- or both the meta- and para- positions of the phenyl group ($R^2$) may be substituted also by the above described monovalent substituents, thereby making it possible to adapt the properties of the couplers and the dyes derived therefrom to the specific purposes of their use. Substitution at both of the ortho positions of the phenyl group ($R^2$) is not preferred, since such substitution significantly reduces the coupling activity of the coupler, and makes the spectral absorption characteristics of the resulting dye unsatisfactory.

The heterocyclic group which may be represented by the group $R^2$ is bound through a carbon atom of the heterocyclic ring to the residual group

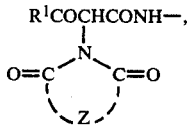

this carbon atom being a member constituting a conjugated electron system of the ring e.g., a carbon atom which because of this exhibits aromatic character. Such heterocyclic groups include those of the thiophene type, such as a 2-thiophenyl, a 3-thiophenyl, a 2-benzothiophenyl, a 3-benzothiophenyl, a 2-naphthothiophenyl or a 3-thiophenyl group; those of the furan type, such as a 2-furyl, a 3-furyl, a 2-benzofuranyl, a 1-isobenzofuranyl or a 3-isobenzofuranyl group, those of the pyran type, such as a 3-pyranyl, a 4-pyranyl, a 5-pyranyl or a 6-pyranyl group, those of the chromene type, such as a 3-chromenyl, or a 4-chromenyl group, those of the pyrrole type, such as a 3-pyrrolyl group; those of the pyrazole type such as a 3-pyrazolyl or a 4-pyrazolyl group; those of the pyridine type, such as a 2-pyridyl, a 3-pyridyl, a 4-pyridyl, a 2-quinolyl, a 3-quinolyl, a 4-quinolyl, a 1-isoquinolyl, a 3-isoquinolyl or a 4-quinolyl group; those of the pyrazine type, such as a 2-pyrazinyl or a 2-quinoxalinyl group; those of the pyrimidine type, such as a 2-pyrimidinyl, a 4-pyrimidinyl, a 5-pyrimidinyl, a 2-quinazolinyl, or a 4-quinazolinyl group; those of the pyridazine type, such as a 2-pyridazinyl, a 3-pyridazinyl, a 3-cinnolinyl or a 4-cinnolinyl group; those of the indolidine type, such as a 1-indolidinyl, a 2-indolidinyl, a 3-indolidinyl, a 5-indolidinyl, a 6-indolidinyl or a 7-indolidinyl group, those of the perimidine type, such as a 2-perimidinyl group, those of the thiazole type, such as a 2-thiazolyl, a 2-benzothiazolyl, a 3-isothiazolyl, a 4-isothiazolyl or a 5-isothiazolyl group; those of the imidazole type, such as a 2-benzoimidazolyl group; those of the oxazole type, such as a 2-oxazole group; those of the 1,3,5-triazine type, such as a 1,3,5-triazinyl group; and those of the oxazine type such as a 2-oxazinyl group. These heterocyclic groups may be further substituted by any suitable substituent, for example, halogen atoms, alkyl groups, alkenyl groups, alkoxy groups, aryl groups, aryloxy groups, carbonyl groups, sulfonyl groups, carboxyl groups, alkoxycarbonyl groups, carbamyl groups, sulfone groups, sulfamyl groups, acylamide groups, ureido groups, sulfonamide groups, amino groups, nitro groups, cyano groups and hydroxyl groups.

As another embodiment of the General Formula (I), there may be mentioned those derivatives in which two residual groups

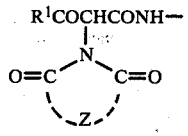

are bound to a heterocyclic group, to two heterocyclic groups combined directly with each other, and to two heterocyclic groups combined via a bivalent group. In this case, such couplers may be represented by the following general formula

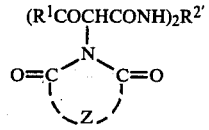

wherein $R^{2'}$ represents a divalent heterocyclic group.

In the above described General Formula (I), the group

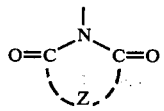

represents a diacylamino group having a 4-, 5-, or 6-membered substituted or unsubstituted heterocyclic ring. In a preferred embodiment, the diacylamino group is selected from dicarboxylic acid imido groups having the following General Formulas (II) to (VII)

General Formula (II)

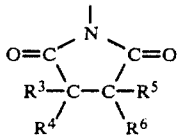

General Formula (IIa)

i.e., in which Z is 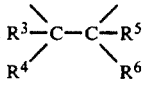

General Formula (III)

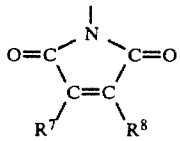

General Formula (IIIa)

i.e., in which Z is 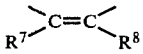

General Formula (IV)

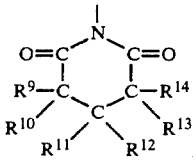

General Formula (IVa)

i.e., in which Z is 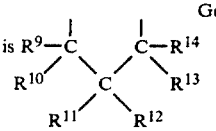

General Formula (V)

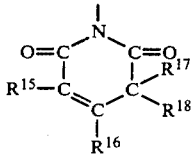

General Formula (Va)

i.e., in which Z is 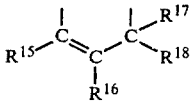

General Formula (VI)

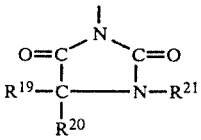

General Formula (VIa)

i.e., in which Z is 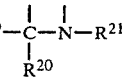

General Formula (VII)

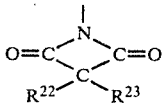

General Formula (VIIa)

i.e., in which Z is 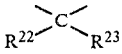

In the above described General Formula (II) and (IIa), (III) and (IIIa), (IV) and (IVa), (V) and (Va), and (VII) and (VIIa) $R^3$, $R^4$, $R^5$, $R^6$, $R^7$, $R^8$, $R^9$, $R^{10}$, $R^{11}$, $R^{12}$, $R^{13}$, $R^{14}$, $R^{15}$, $R^{16}$, $R^{17}$, $R^{18}$, $R^{22}$ and $R^{23}$ are each a monovalent substituent such as a hydrogen atom, a halogen atom such as a fluorine, a chlorine or a bromine atom, a substituted or an unsubstituted alkyl group having from 1 to about 32 carbon atom, preferably having from 1 to about 20 carbon atoms, an alkoxy group, an aryl group, an aryloxy group, a sulfone group, or a carboxyl group. In the formula (VI) and (VIa), $R^{19}$, $R^{20}$ and $R^{21}$ each represents a hydrogen atom, a substituted or unsubstituted alkyl group having from 1 to about 32 carbon atoms, preferably from 1 to about 20 carbon atoms or an aryl group. Moreover, the groups $R^3$ and $R^5$ in the General Formulas (II) and (IIa), $R^7$ and $R^8$ in the General Formula (III) and (IIIa), $R^9$ and $R^{11}$, and $R^{12}$ and $R^{13}$ in the General Formula (IV) and (IVa), and $R^{15}$ and $R^{16}$, and $R^{16}$ and $R^{17}$ in the General Formula (V) and (Va) may be combined together to form a 5- or 6-membered ring which may be either saturated or unsaturated. Examples of such rings include a benzene ring, a pyridine ring, a cyclohexane ring, a furan ring, a bicycloheptane ring, a bicycloheptane ring, and a cyclohexene ring.

Specific examples of the residual group

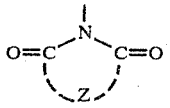

in the General Formula (I) include the following:

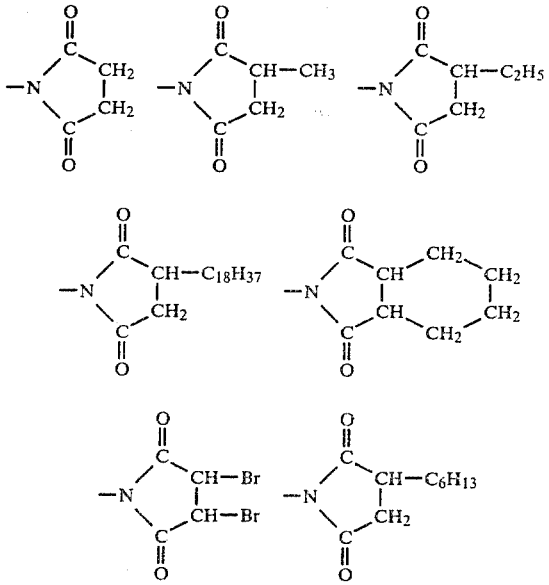

-continued
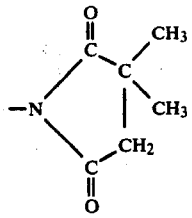
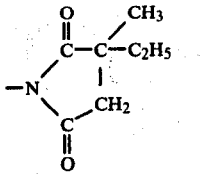
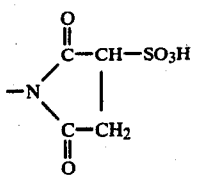
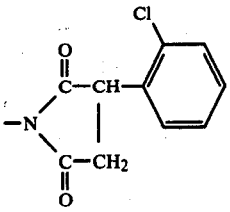
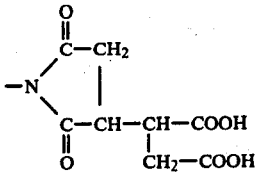
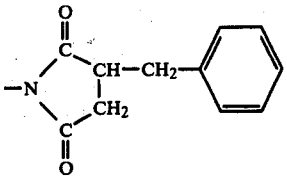
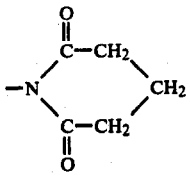
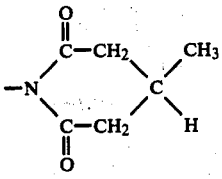
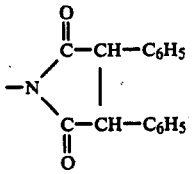
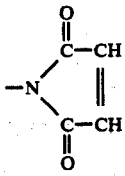
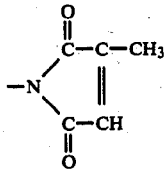
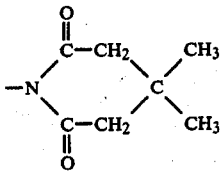
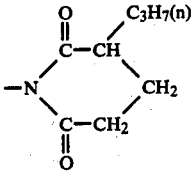
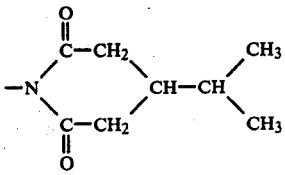
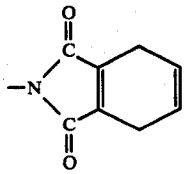
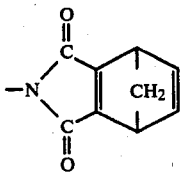
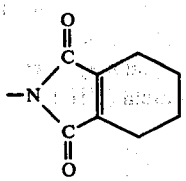
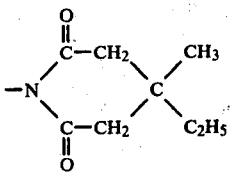
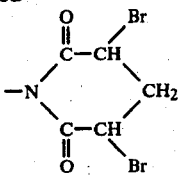
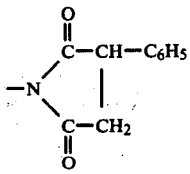
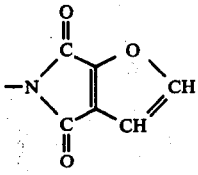
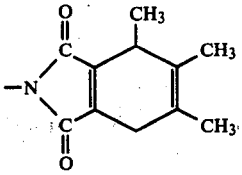
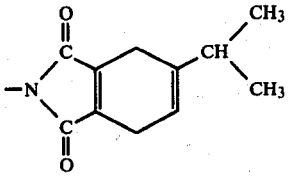
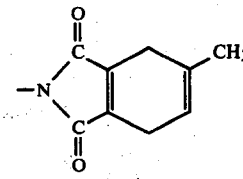
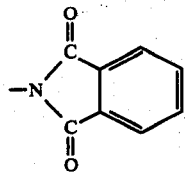
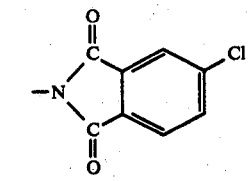
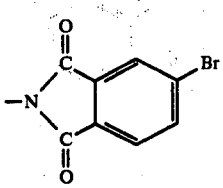
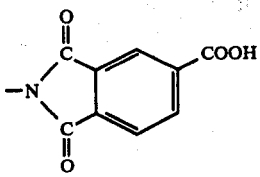
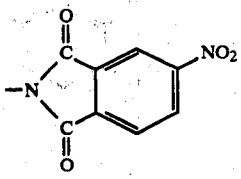
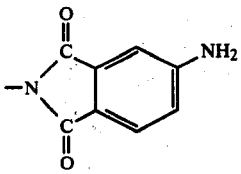
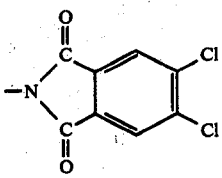
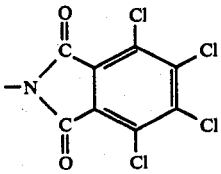
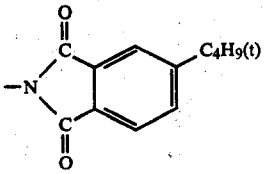
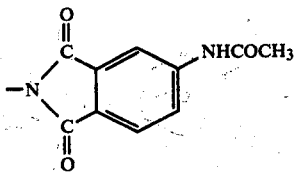

-continued
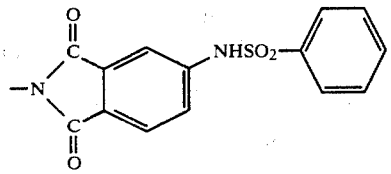
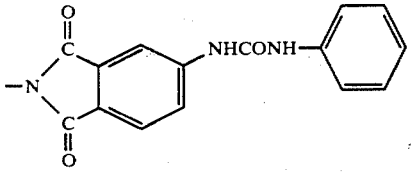
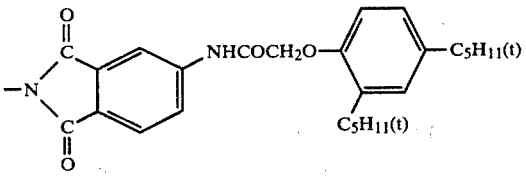
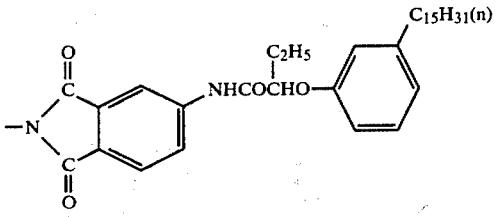
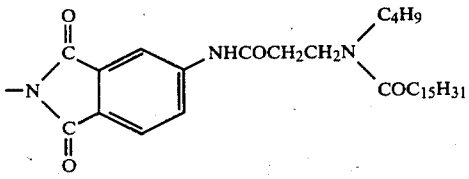
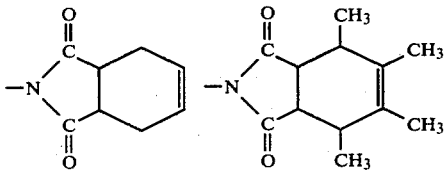
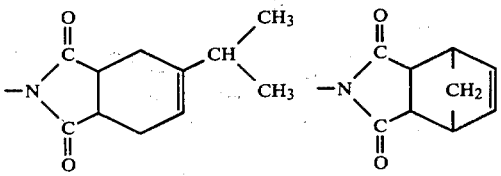
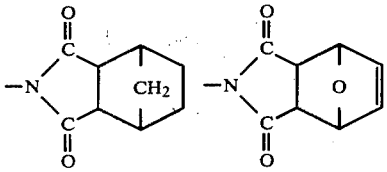
-continued
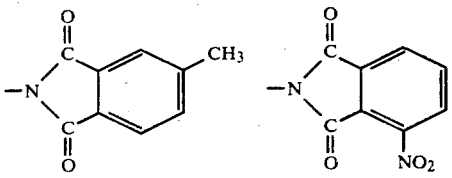
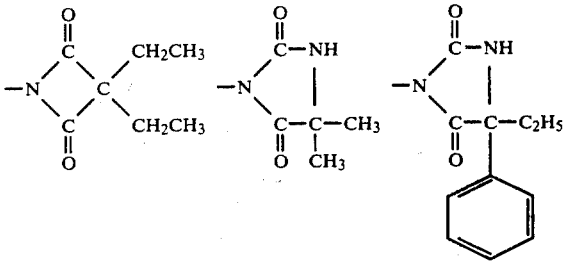
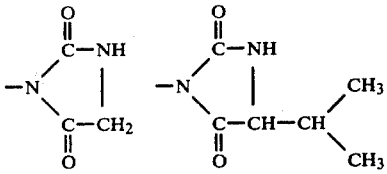
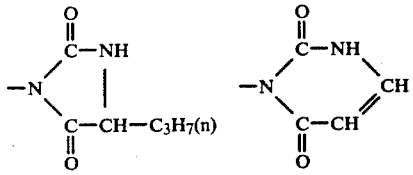
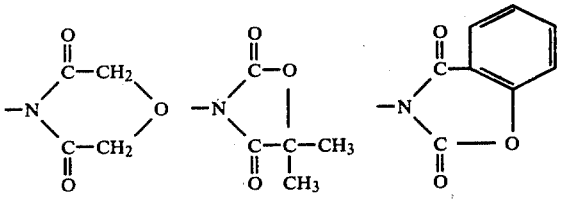
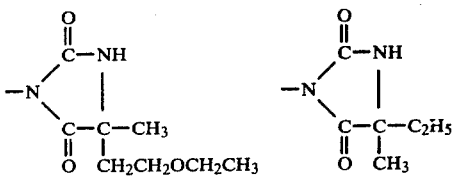
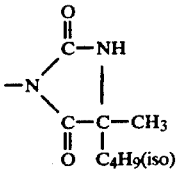
Among the compounds of the General Formula (I), those particularly suitable for embodiments of the present invention may be represented by the following General Formula (VIII):

General Formula (VIII)

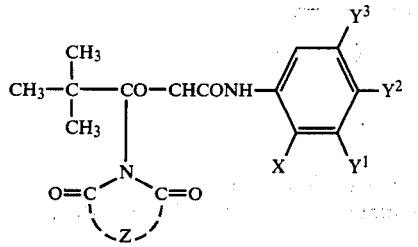

wherein Z represents the same group of atoms as defined in the above described General Formula (I), X is a halogen atom, an alkoxy group, an aryloxy group, or a tertiary amino group, and $Y^1$, $Y^2$ and $Y^3$, which may be the same or different, are each selected from the group consisting of hydrogen atoms, halogen atoms, alkyl groups, alkenyl groups, alkoxy groups, aryl groups, aryloxy groups, carbonyl groups, sulfonyl groups, carboxyl groups, alkoxycarbonyl groups, carbamyl groups, sulfone groups, sulfamyl groups, acylamino groups, ureido groups, sulfonamide groups, amino groups, nitro groups, and cyano groups. Compounds having the General Formula (VIII) which are particularly suitable for the present invention are those in which the residual group

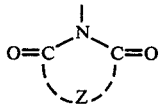

is selected from the groups having the General Formulas (II), (III), (IV), (V), (VI) and (VII).

The silver halide photographic emulsion used in the present invention comprises a dispersion of a light-sensitive silver halide, such as silver chloride, silver bromide, silver chlorobromide, silver iodobromide, or silver chloroiodobromide, in a hydrophilic high molecular weight substance, in which dispersion the silver halide is present in the form of colloidal particles. The emulsion may be prepared by any conventional method. The hydrophilic high molecular weight substance contained in photographic emulsions suitably may be proteins such as gelatin, high molecular weight non-electrolytes such as polyvinyl alcohols, polyvinyl pyrrolidones or polyvinyl acrylamides or high molecular weight amphoteric electrolytes such as polyacrylamides treated by the Hofmann reaction or acrylic acid-N-vinyl imidazole copolymers. The silver halide photographic emulsion may further contain therein sensitizers such as (a) speed-increasing compounds such as those described in U.S. Pat. Nos. 2,271,623, 2,288,226, 2,334,864, and 2,708,162, and (b) compounds increasing the light-sensitivity of the silver halide as disclosed in British Pat. No. 1,221,875, German Offenlegundschrift No. 2,137,559, and Japanese Patent Application Nos. 19034/70 and 30023/71; stabilizers such as benzotriazole, 5-nitrobenzimidazole, 1-phenyl-5-mercaptotertrazole, and 4-hydroxy-6-methyl-1,3,3a,7-tetrazaindene; hardeners such as those described in U.S. Pat. Nos. 3,325,287 and 3,362,827 and Japanese Patent Nos. 257,564 and 309,487; surface active agents such as those described in U.S. Pat. No. 3,441,413 and British Pat. Nos. 1,164,095 and 1,012,495; anti-oxidants such as those described in U.S. Pat. Nos. 2,360,290 and 2,403,721 and/or other photographically useful adjuvants.

The aromatic primary amino developer used in this invention is either a compound capable of developing exposed silver halide, or a precursor forming such a compound. In practice of the present invention, o-amino-phenol, p-aminophenol and N,N-di-substituted-o-phenylene-diamines, and particularly N,N-p-phenylenediamine, can be used to advantage. Examples of such developers include 4-amino-3-dimethylamino-N,N-diethylaniline, 4-amino-3-ethoxy-N,N-diethylaniline, 4-amino-3,5-dimethyl-N,N-diethylaniline, 4-amino-3-methyl-N-ethyl-N-(β-hydroxyethyl) aniline, 4-amino-3-methyl-N,N-diethylaniline, 4-amino-3-methyl-N-ethyl-N-(β-methylsulfonamidoethyl)-aniline, 4-amino-3-(β-methylsulfonamidoethyl)-N,N-diethylaniline, 4-amino-N-ethyl-N-(b-hydroxyethyl)-aniline, 4-amino-N,N-diethylaniline, and 4-amino-N-ethyl-N-(Ω-sulfobutyl)aniline. Additional examples are disclosed in British Pat. No. 811,679 and in the J. Am. Chem. Soc., Vol. 73, Page 3100–3125 (1951). Using these developers, the exposed photographic emulsion is processed in the presence of an alkali, and, if desired, in the presence of antioxidants, antifoggants and the like.

The photographic processes in which dye images are formed by the oxidative coupling reaction of the coupler with the oxidation product of aromatic primary amino developer, are predominantly divided into two processes, depending on the manner in which the coupler is added. One is called "coupler-in-emulsion type" where the coupler is incorporated into an emulsion in the course of the manufacturing the light-sensitive material. The second is called "coupler-in-developer type", where a coupler is dissolved in a developing composition and provided upon development into an emulsion by diffusion.

When a coupler is used in the process of the former type, it should be fixed in an emulsion, i.e., it should be protected against diffusion, because the coupler otherwise would migrate from the emulsion layer having the corresponding spectral sensitivity and form its dye in a different emulsion layer thereby reducing the color-reproducing ability of the light-sensitive element.

To make a coupler diffusion-resistant, groups having a hydrophobic residual group having from 8 to 32 carbon atoms may be introduced into the coupler molecule. Such residual groups are generally called "ballast groups". The ballast group may be bonded to the coupler moiety, either directly or via an amino bond, an ether bond, a thioether bond, a carbonamide bond, a sulfonamide bond, urea bond, an ester bond, an imide bond, a carbonyl bond or a sulfonyl bond.

Examples of such ballast groups are illustrated in the following.

(i) Alkyl and alkenyl groups:

For example,

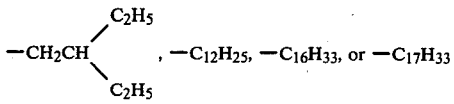

(ii) Alkoxyalkyl groups:

For example, $-(CH_2)_3O(CH_2)_7CH_3$ or $-(CH_2)_3OCH_2-CH(C_2H_5)-(CH_2)_8CH_3$ as described in Japanese Patent Publication No. 27563/'64

(ii) Alkylaryl groups:

For example,

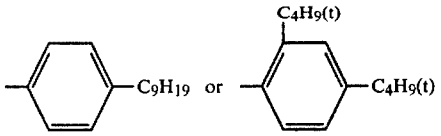

(iv) Alkylaryloxyalkyl groups:

For example,

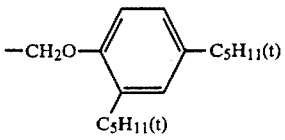

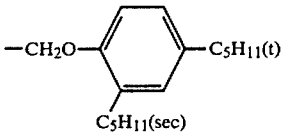

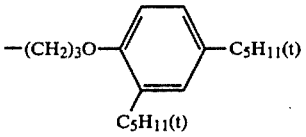

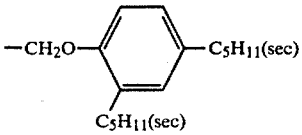

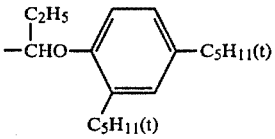

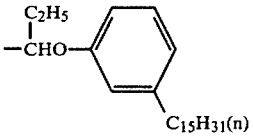

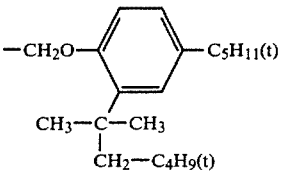

or

-continued

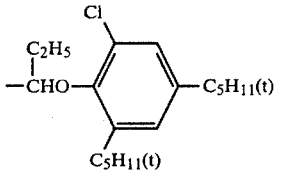

(v) Acylamidoalkyl groups:

For example, U.S. Pat. Nos. 3,337,344 and 3,418,129 describe the following:

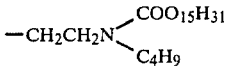

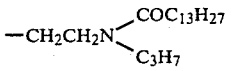

or

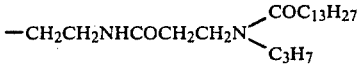

(vi) Alkoxyaryl and aryloxyaryl groups:

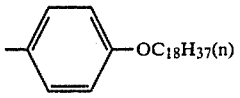

or

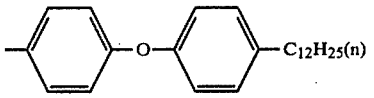

(vii) Residual groups containing a long chain aliphatic group, such as an alkyl and/or an alkenyl group, together with a carboxyl or a sulfo group:

For example,

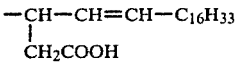

or

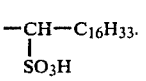

Oil-soluble, diffusion-resistant couplers for use in the coupler-in-emulsion process are first dissolved in an organic solvent and then incorporated, as dispersed fine colloidal particles, into a light-sensitive material. Methods for dispersing the couplers of the present invention are described in detail in our copending U.S. application Ser. No. 852,465, filed Aug. 20, 1969. Organic solvents which may be used to dissolve such couplers and which can be present in the light-sensitive material, together with the couplers are, preferably, water-insoluble solvents, having high boiling points, for example, 190° C. and above. Such organic solvents include substituted hydrocarbons, carboxylic acid esters, carboxylic acid amides, phosphoric acid esters and acid ethers, such as, di-n-butyl phthalate, di-isooctyl azelate, di-n-butyl sebacate, tri-cresyl phosphate, tri-n-hexyl phosphate, N,N-diethyl caprylamide, butyl-M-pentadecylphenyl ether and a chloroparaffin. It is also advantageous to use an adjuvant solvent together with the above-described high boiling point organic solvent, in order to dissolve the coupler into the latter. The adjuvant solvent should be such one that can be removed in the course of manufacture of a light-sensitive material, from said material. Such adjuvant solvents include propylene carbonate, ethyl acetate, butyl acetate, cyclohexanol, tetrahydrofuran, and cyclohexane.

In order to help these oil-soluble, internal-type couplers disperse, in their finely divided form, into the hydrophilic polymeric substance for use as a photographic emulsion, a surface active agent can be used to advantage. Particularly preferred surface active agents include anionic surface active agents such as sodium cetyl sulfate, sodium p-dodecylbenzene sulfonate, sodium nonylnaphthalene sulfonate, sodium di-(2-ethylhexyl)-α-sulfosuccinate, or the like, and nonionic surface active agents such as sorbitan sesqui-oleic acid ester, sorbitan monolauric acid or the like. For purposes of dispersing the oil-soluble coupler, there may be used to advantage a homogenizer for use in emulsification, a colloid mill, an ultrasonic emulsifying apparatus or the like. The diffusion-resistant couplers of the General Formula (1) having, together with the ballast group, carboxylic acid groups and/or sulfonic acid groups in their molecule are soluble in a neutral or weakly alkaline aqueous solution. Incorporation of the coupler into a photographic emulsion may be effected by adding such an aqueous solution into the photographic emulsion. It is generally believed that the coupler thus incorporated be made diffusion-resistant through micelle formation in the hydrophilic polymeric substance.

Examples of the internal-type couplers of the present invention are illustrated in the following.

| Coupler | |
|---|---|
| 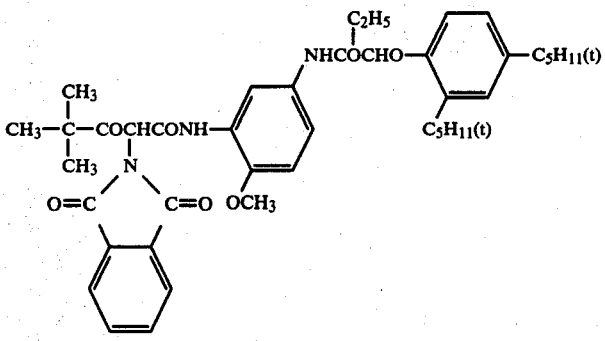 | (1) |
| 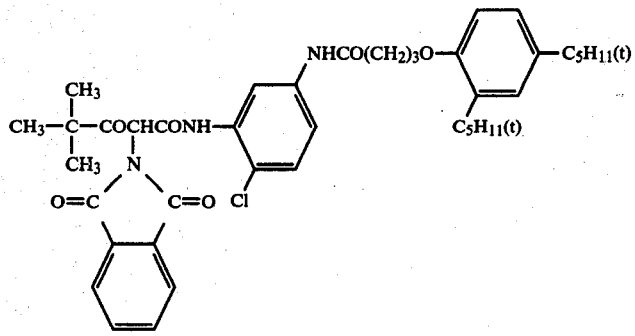 | (2) |
| 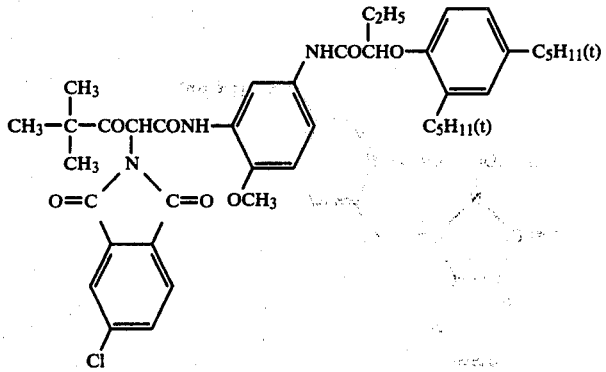 | (3) |

-continued
Coupler
(4)
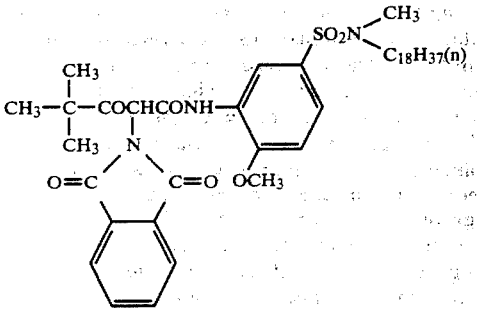
(5)
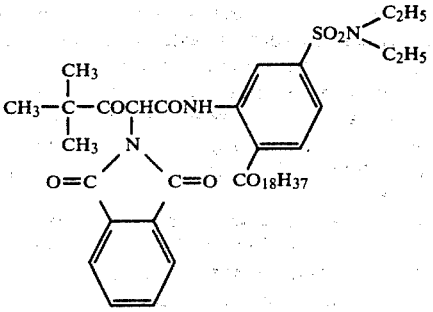
(6)
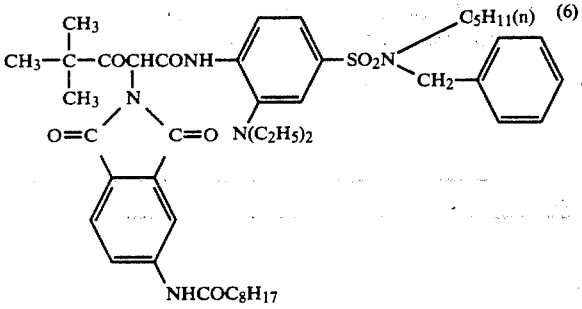
(7)
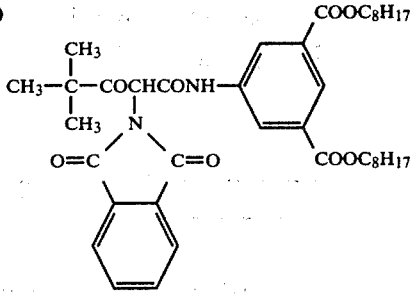
(8)
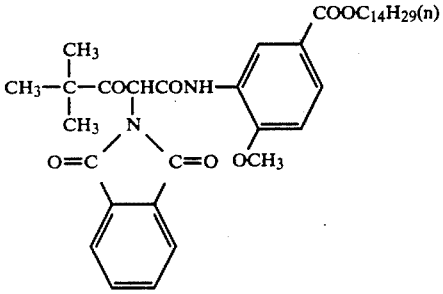
(9)
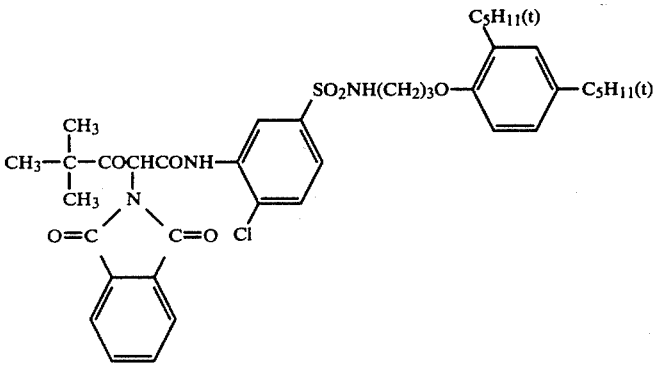
(10)
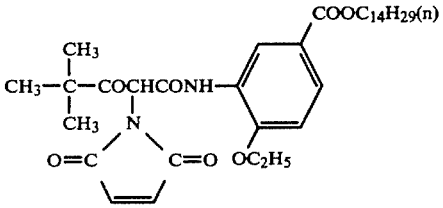
(11)
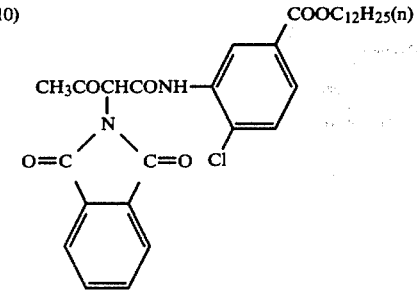

-continued
Coupler
(12)
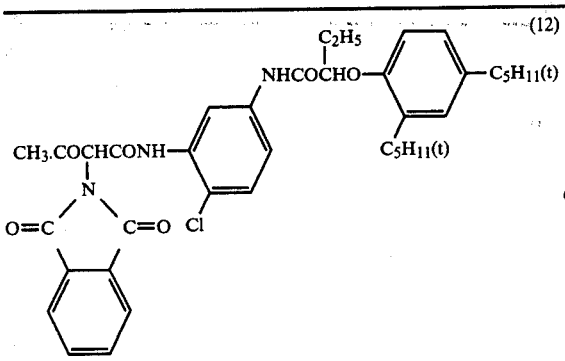
(13)
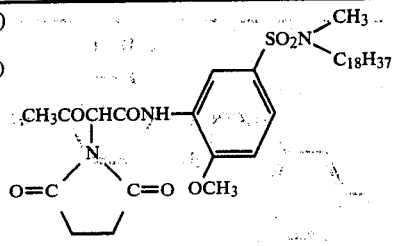
(14)
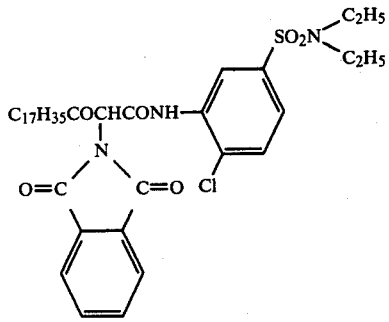
(15)
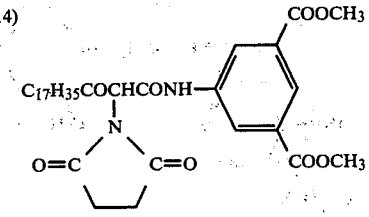
(16)
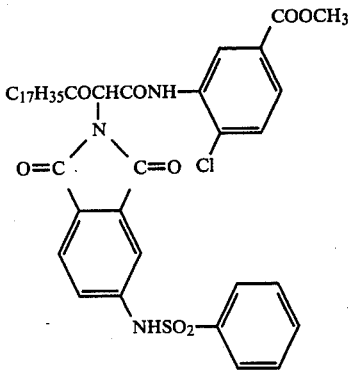
(17)
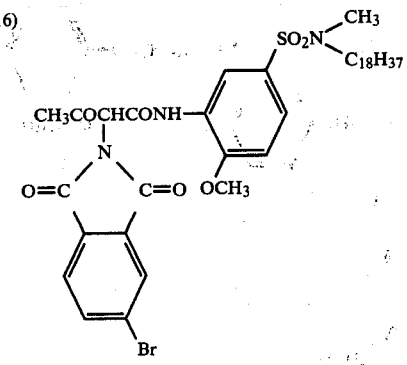
(18)
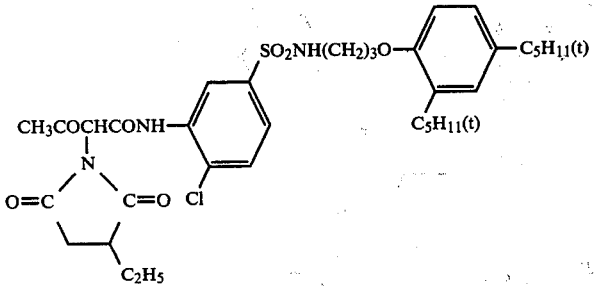
(19)
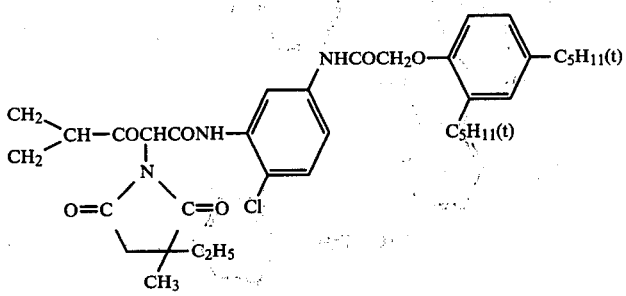

-continued
| Coupler | |
|---|---|
| 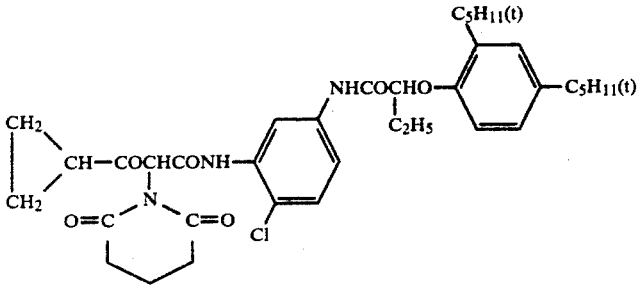 | (20) |
| 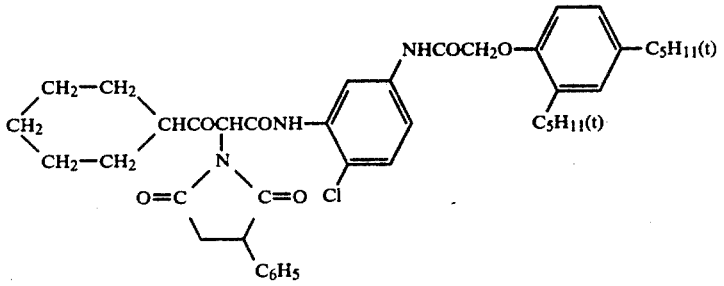 | (21) |
| 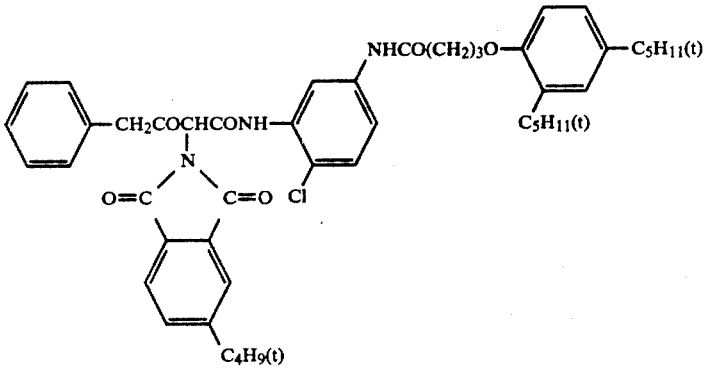 | (22) |
| 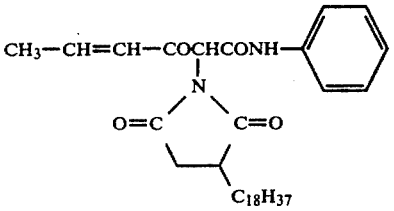 | (23) 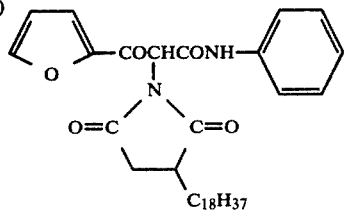 (24) |
| 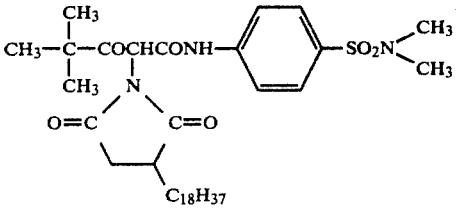 | (25) 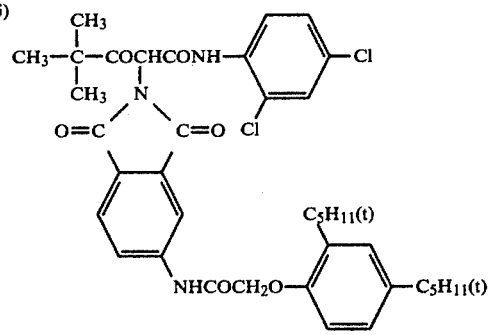 (26) |

-continued
| Coupler | |
|---|---|
| 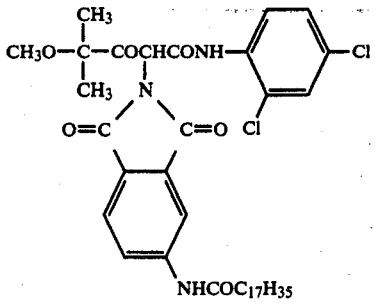 | (27) |
| 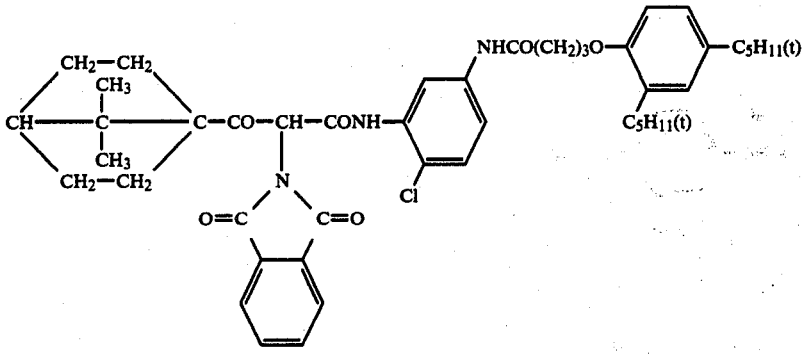 | (28) |
| 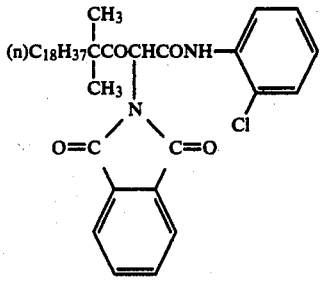 | (30) |
| 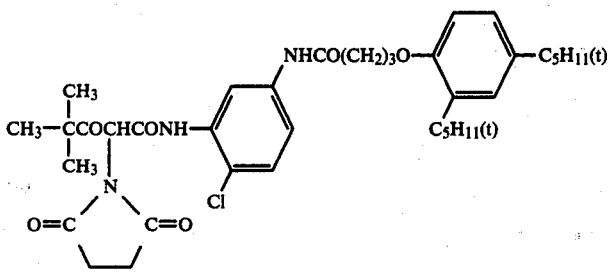 | (30) |
| 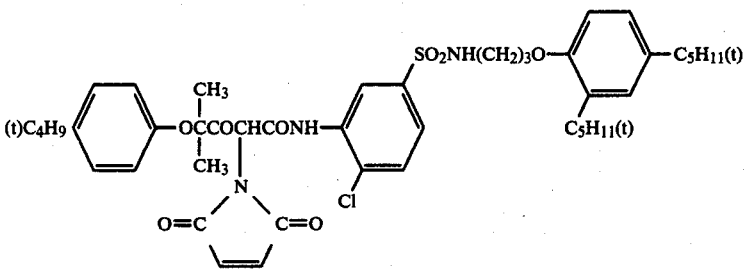 | (31) |

-continued
| Coupler | |
|---|---|
| 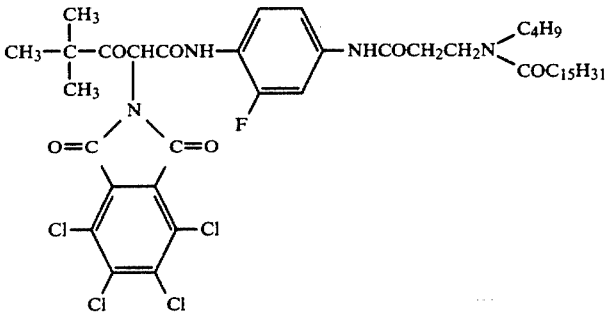 | (32) |
| 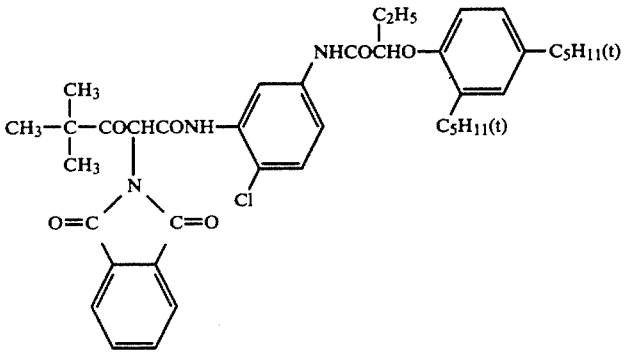 | (33) |
| 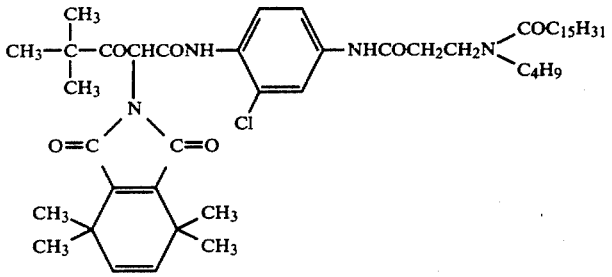 | (34) |
| 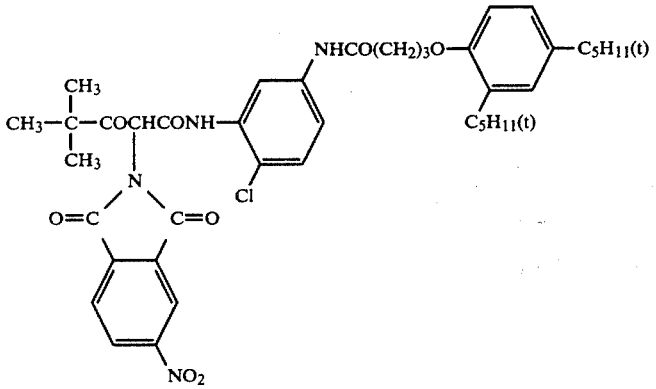 | (35) |

-continued
Coupler
(36)
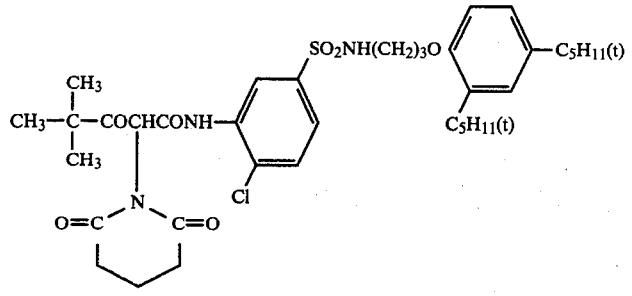
(37)
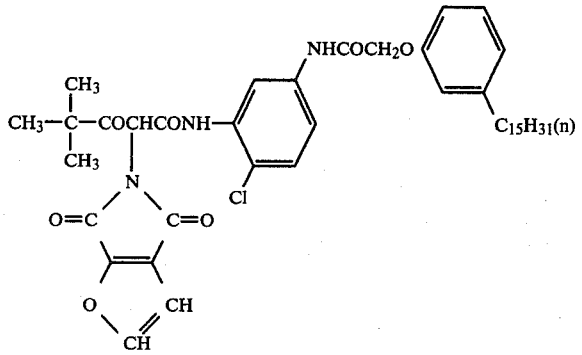
(38)
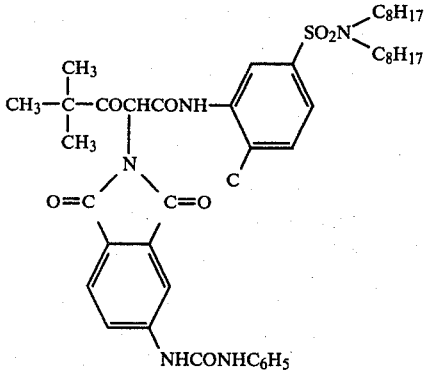
(39)
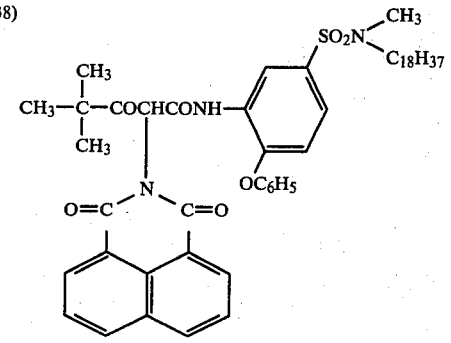
(40)
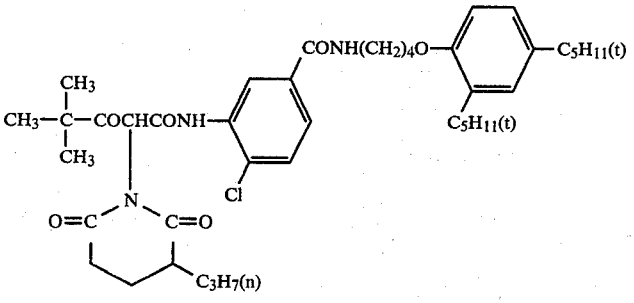
(41)
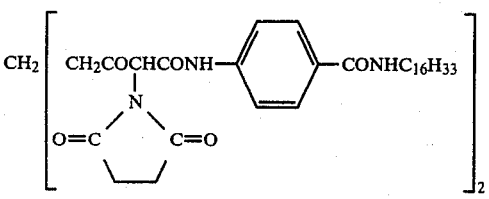
(42)
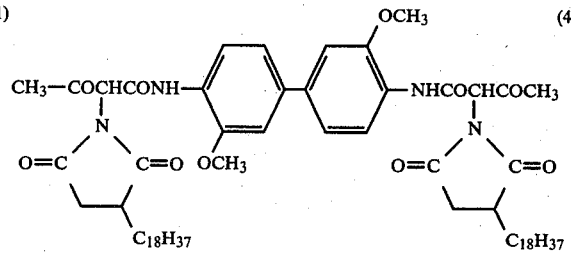

-continued
Coupler
(43)
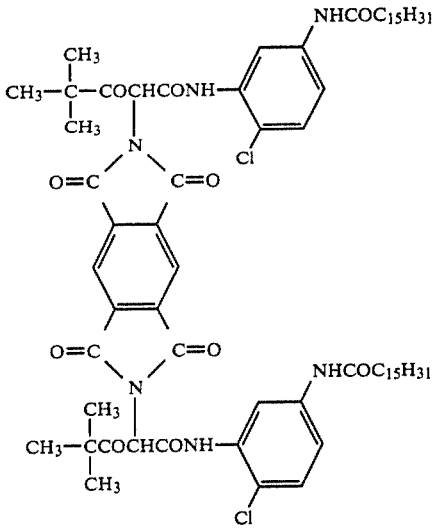
(44)
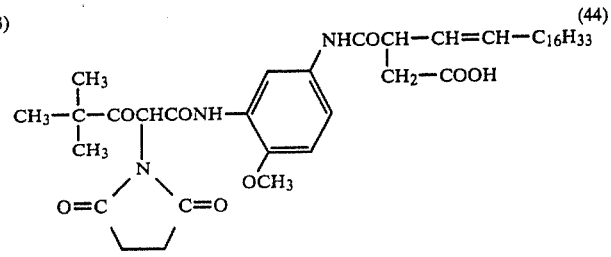
(45)
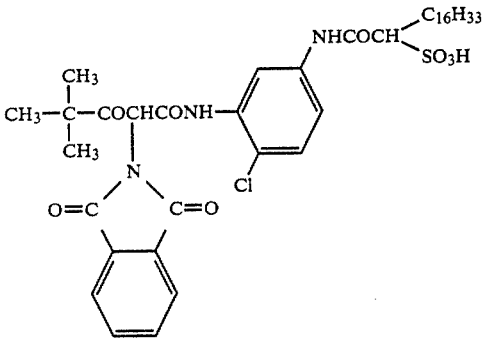
(46)
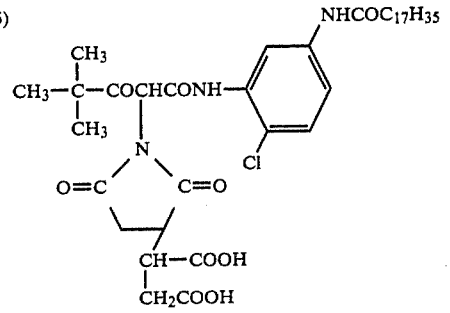
(47)
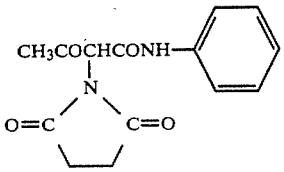
(48)
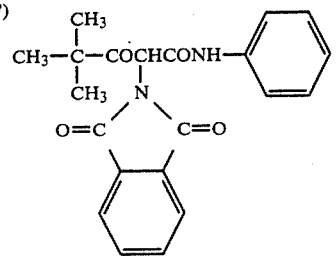
(49)
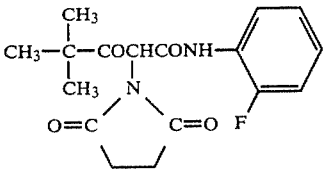
(50)
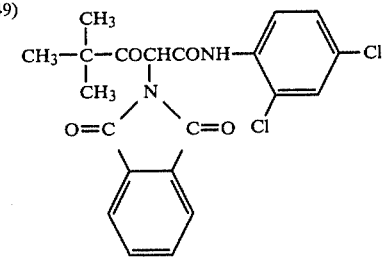

-continued
Coupler
(51)
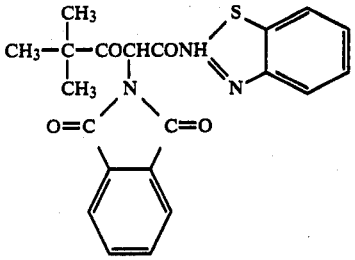
(52)
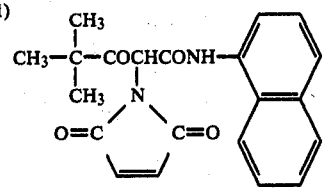
(53)
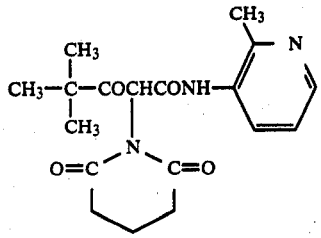
(54)
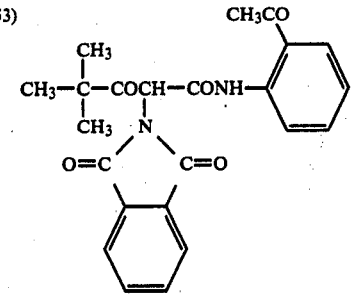
(55)
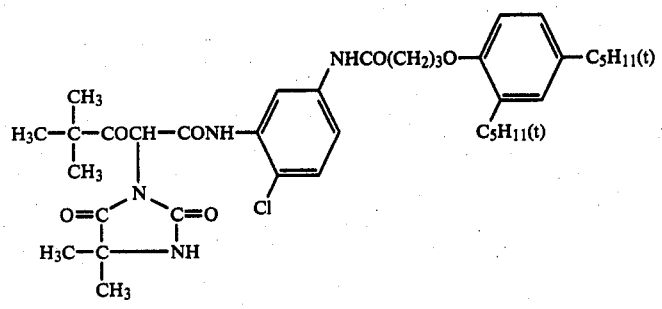
(56)
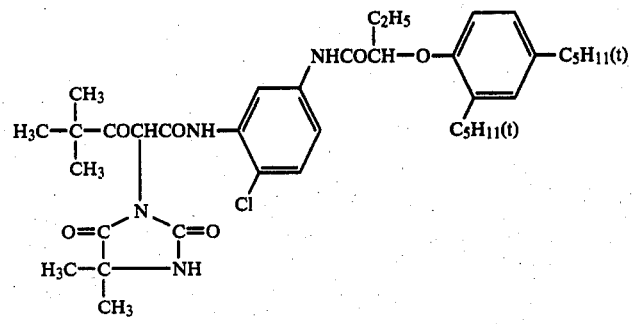
(57)
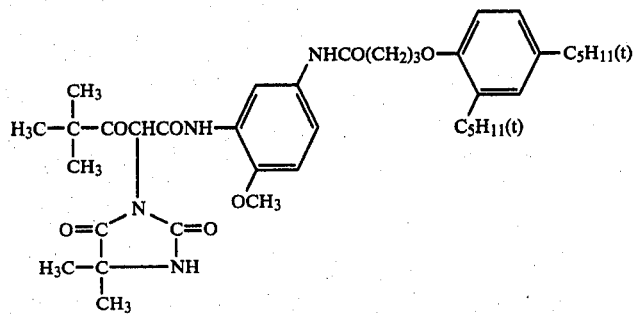

-continued
| Coupler | |
|---|---|
| 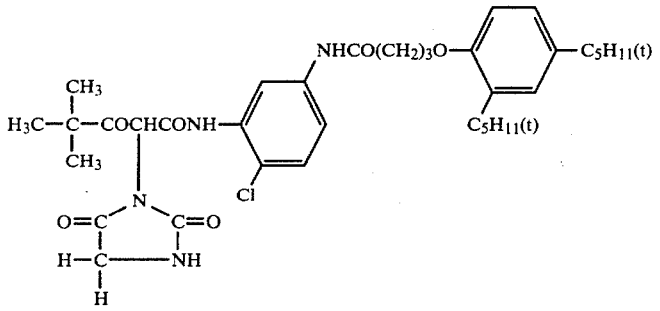 | (58) |
| 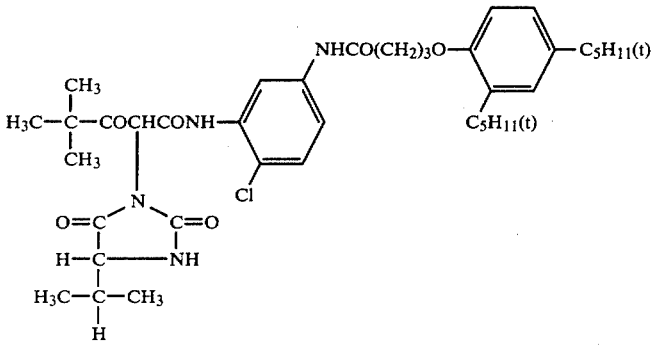 | (59) |
| 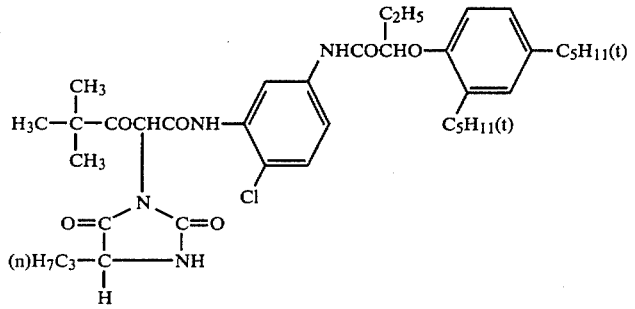 | (60) |
| 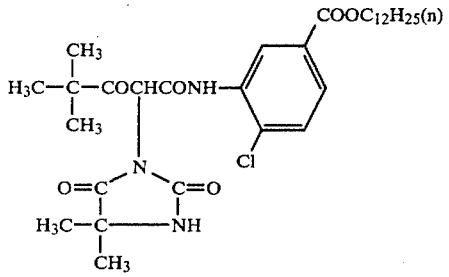 | (61) |
| 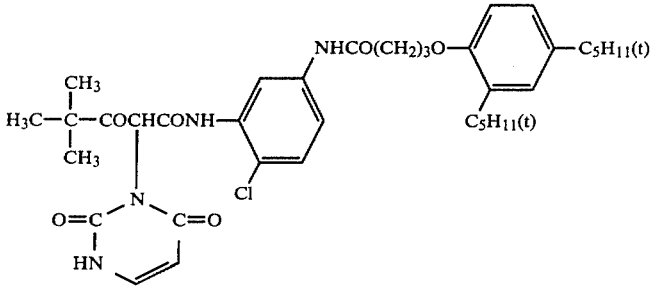 | (62) |

-continued
Coupler
(63)
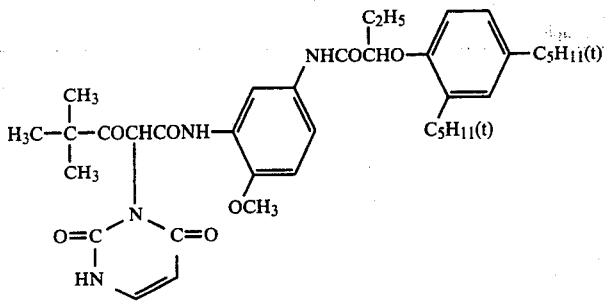
(64)
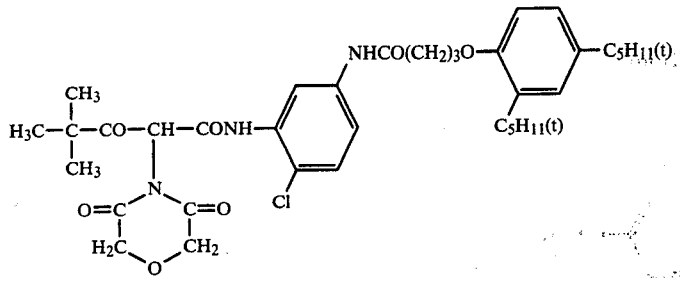
(65)
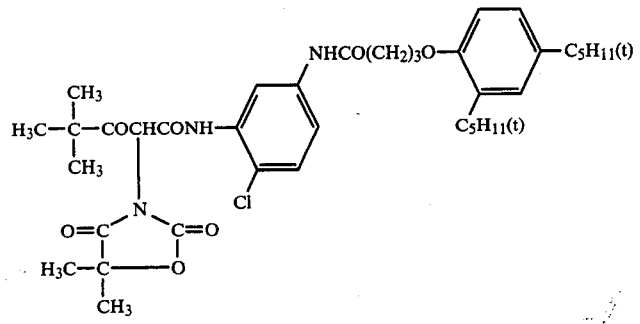
(66)
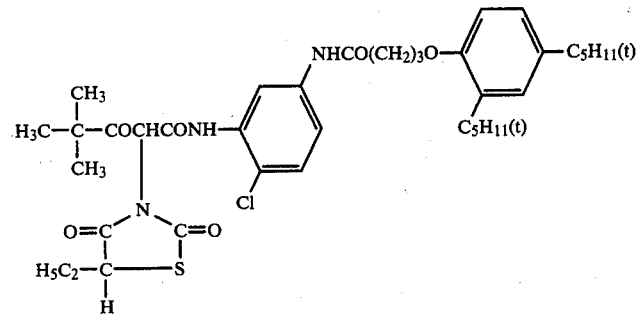
(67)
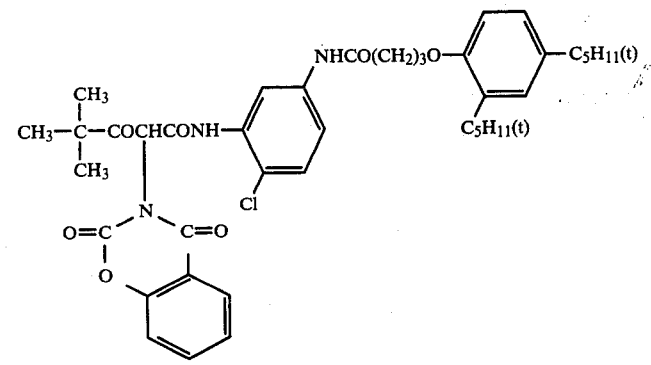

-continued
| Coupler | |
|---|---|
| 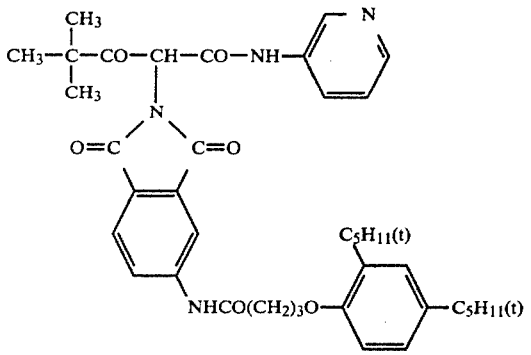 | (68) |
| 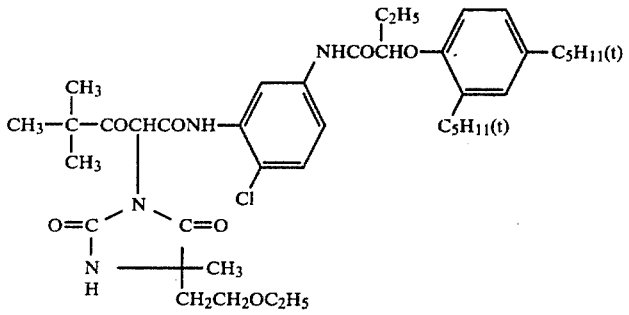 | (69) |
| 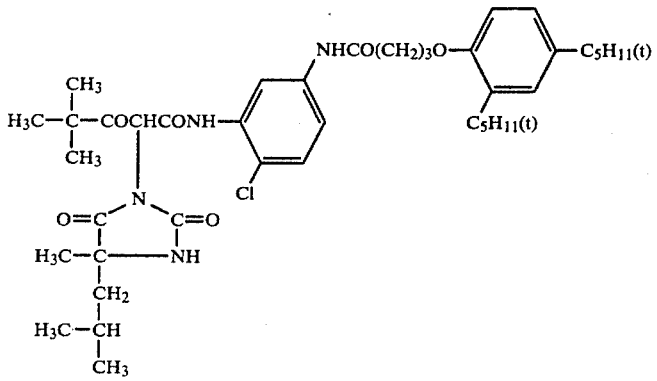 | (70) |
| 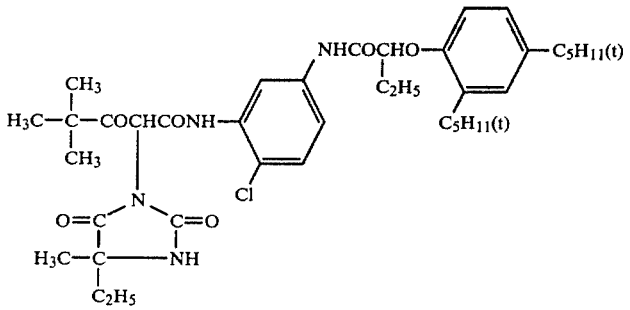 | (71) |

-continued
| Coupler | |
|---|---|
| 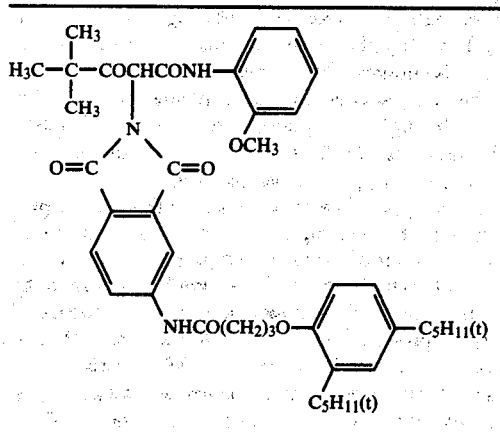 (72) | 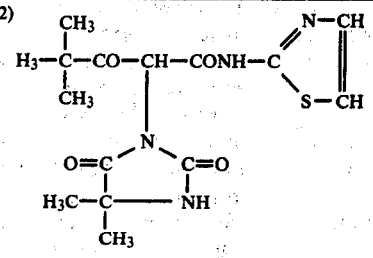 (73) |
| 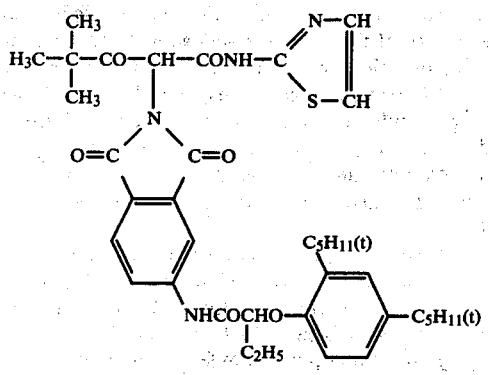 (74) | 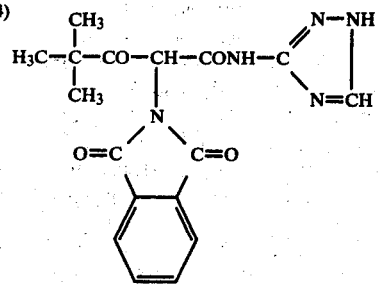 (75) |
| 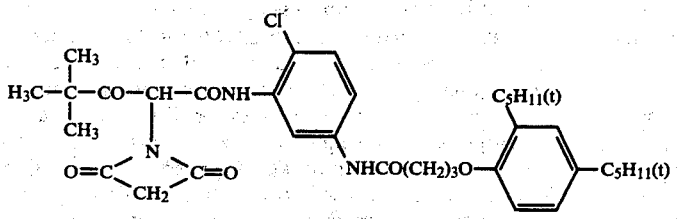 (76) | |
| 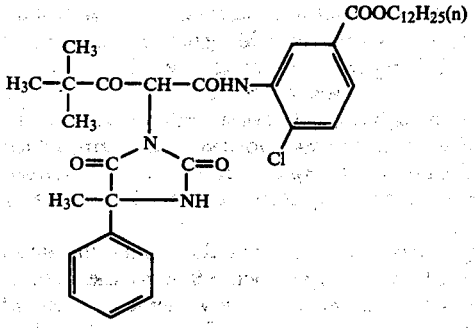 (77) | |
| 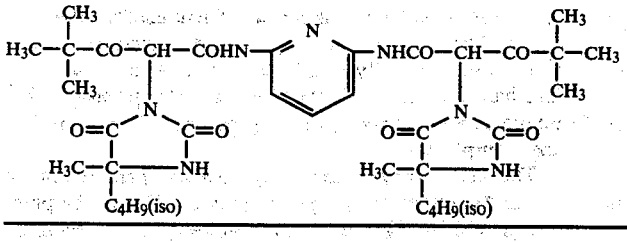 (78) | |
The amount of the coupler used according to the invention depends upon specific light-sensitive elements in which the coupler is used and upon the types of development processing, although a preferred amount is, in the case of the coupler of the internal type, a molar ratio in the range of from 0.02 to 1.0, preferably from 0.1 to 0.5, per mole of silver halide present in the emulsion of the element used. When amounts less than 0.02 are used, a large amount of silver halide will be necessary in order to achieve a sufficient degree of color formation and light absorption in the resulting light-sensitive element, which results in an increase in light scattering in the emulsion layer and therefore in a degradation in the sharpness of the resulting image. Furthermore, increasing the amount of the silver halide coated on the photographic material results in increase in thickness of the emulsion layer, thereby lessening the speed of the development process. When amounts more than the 1.0 are used, conversion of the coupler to the dye is insufficient, thus lessening the efficiency of the coupler, and, in addition to these economical disadvantages, disadvantages resulting from the increase in thickness of the emulsion layer results. In the case of a coupler in the developer type the coupler will be present in the developing bath at a level of from 0.1 to 10, preferably from 0.5 to 5, g/liter of developer. As described in the foregoing, when amounts outside the range described above are used, the advantages and objects according to the present invention cannot be accomplished sufficiently.

In practice of the present invention, the couplers represented by the General Formula (I) may be used either alone or as combinations thereof. Furthermore, they may be used in combination with other couplers than those of the General Formula (I), for example, with couplers as disclosed in U.S. Pat. Nos. 2,875,057; 3,265,506; 3,138,604; 3,341,331; and 3,409,439 and in British Pat. Nos. 1,113,038 and 1,141,275.

A light sensitive photographic emulsion layer containing the yellow image forming couplers of this invention can be coated on any conventionally used photographic support. Typical such supports include cellulose ester films such as cellulose acetate films, polystyrene films, polycarbonate films, polyester films such as polyethylene terephthalate films, papers, resin coated papers and glass. The amount of the couplers coated on the support can generally range from $2\times10^{-4}$ to $5.0\times10^{-3}$ mol/m$^2$ of the support.

The structure characteristic of the couplers used according to the present invention is that only one hydrogen atom on the α-carbon atom of the α-(aliphatic acyl) acetoamide is replaced by a N-cyclic carboimide group, i.e., the nitrogen atom activated by the adjacent two carbonyl groups is bound to the α-carbon atom of the acylacetoamide. It is considered that the oxidation product of the aromatic primary amino developer is reacted with the above-described α-carboimideacylacetoamide by splitting the bond between the imide nitrogen atom and the α-carbon atom, thereby forming an azomethine dye and imide ion. On the other hand, in the heretofore known acylacetoanilides, the α-substituents are halogen atoms and substituents which are bound to the α-carbon atom via an oxygen or a sulfur atom. Accordingly the imide-substituted couplers according to the present invention are clearly distinguished from the couplers of prior art.

The α-diacylamino-acetylacetoamide-type couplers used according to the present invention have the following advantageous characteristics.

The α-diacylamino-acylacetoamide-type couplers used in the present invention are 2-equivalent couplers, i.e. only 2 moles of the oxidizing agent, i.e. silver halide, are necessary for the formation of one mole of the dye, while the heretofore widely used couplers of the acylacetoamide type are 4-equivalent couplers. Accordingly the amount of the coupler used in the present invention is half the amount of the prior art 4-equivalent couplers, which results in reduction in the amount of the silver halide contained in photographic elements thereby lowering their manufacturing cost. In addition to these advantages, the couplers of the invention improve the sharpness of the colored image obtained by reducing the light scattering caused by the emulsion particles, and enable the use of a thin emulsion layer, thereby accelerating the development process.

The imido-type couplers used according to the present invention have a high coupling reactivity to the oxidation product of the aromatic primary amine developing agent, which results in a rapid removal of the oxidation product of the aromatic primary amine developing agent produced upon color development, thereby accelerating the development of the silver halide emulsion. The formation of dye images according to the present invention is carried out in this way within a reasonably short period of time. Due to the high coupling reactivity of the couplers according to the invention, sufficient color density is formed even when the amount of the solvent used to disperse the oil-soluble couplers, particularly a non-volatile solvent, is largely reduced. Thus, the residual amount of solvent in light-sensitive elements can be reduced, so that it is possible to improve the mechanical strength of the emulsion layer film.

The dye forming process using the imido-substituted acylacetoanilide-type couplers of the present invention can be completed in a color developing bath, so that the subsequent use of a bleach bath containing a strong oxidizing agent such as potassium ferricyanide or potassium dichromate is unnecessary, thus enabling processing with a blix bath containing both a weaker oxidizing agent such as a ferric chelate of EDTA and a silver complexing agent, and thereby facilitating the solution of problems resulting from water pollution caused by discharge of processing liquors, and also shortening the overall process of color development. On the other hand, in the case of many of the couplers of the acylacetamide type where their position pertaining the coupling reaction is not substituted, specifically almost all of the couplers where the imide group in the general formula (VI) is replaced by a hydrogen atom, the color forming reaction cannot be completely effected in a color developing bath, and a considerable portion of the coupler still remains in its colorless leuco form, which requires the use of a strong oxidizing agent as described above in order to completely develop the remaining leuco dye.

The dye image derived from the imide-substituted acylacetamide-type coupler according to the present invention shows an extremely low tendency toward deterioration, even when stored for a long period of time under severe conditions. Particularly, the dye image derived from the couplers of the general formula (VI) is substantially unaffected by light and moisture and has sufficient stability that the color photographic image can be stored for a long period of time without any complications.

The silver image which may be formed in the course of the dye image forming process according to the present invention can be easily oxidized in a bleach or bleach-fix bath, so that it can be completely removed within a short processing time, thereby giving a sharp yellow dye image without any staining by the residual silver image.

The imide group-substituted acylacetamide-type couplers used according to the present invention can be prepared in high yields, using as starting material those compounds which are commercially available. Moreover, by suitably selecting the Z group in the above general formulas, the properties, particularly the coupling reactivity of the couplers, can be freely adjusted in accordance with the specific purpose of the lightsensitive element used. That the adjustment of photographic properties has been made possible by the choice of the Z group is of great significance, since the structural change in the nucleus of the acylacetamide is in general strictly limited because it gives rise to alterations not only in the reactivity of the coupler, but also in the spectral absorption characteristic of the dye image formed.

The couplers used according to the present invention and the dye image obtained therefrom are particularly advantageous with respect to all of the photographic properties described above individually.

The couplers of the present invention may be generally prepared by reacting a halide of the corresponding mother couplers, in the presence of a base such as triethylamine, with the corresponding amide.

Examples in which the synthesis of the couplers of this invention are shown are as follows.

SYNTHESIS 1

α-Pivalyl-α-phthalimido-2-chloro-5-[γ-(2,4-di-tert.-amylphenoxy)butyramido]2-chloroacetanilide-Coupler (2)

Into 300 cc. of acetonitrile were dissolved 25 g. of α-pivalyl-α-chloro-5[γ-(2,4-di-tert.-amylphenoxy)-butyramido]-2-chloroacetoanilide and 6.1 g. of phthalimide. Into this solution was added 5 g. of triethylamine and the mixture heated under reflux for 8 hours.

After the reaction was completed about 150 cc. of acetonitrile was distilled off under reduced pressure. The residue was cooled with ice and the precipitated product was collected by filtration, and recrystallized from ethanol to give 15 g. of the coupler named above.

M.P. 197°-198° C.

Analysis: Calculated for $C_{41}H_{50}ClN_3O_6$: C 68.76%, H 6.99%, N 5.87%. Found: C 68.54%, H 7.18%, N 6.04%.

SYNTHESIS 2

α-Pyvalyl-α-succinimido-5[γ-(2,4-di-tert.-amylphenoxy)butyramido]-2-chloroacetanilide-Coupler (30)

Into 100 cc. of acetonitrile were dissolved 15 g. of α-pivalyl-α-chloro-5[γ-(2,4-di-tert.amylphenoxy)-butyramido]-2-chloroacetanilide and 2.5 g. of succinimide. Into the solution was added 2.5 g. of triethylamine and the mixture was heated under reflux for 8 hours. After the reaction was completed the acetonitrile was distilled off under reduced pressure. The residue was dissolved in 50 cc. of acetic acid, and the solution added dropwise to 1 liter of water. The product formed thereby was recrystallized from methanol to give 11 g. of the coupler set forth above.

M.P. 178°-180° C.

Analysis: Calculated for $C_{37}H_{50}ClN_3O_6$: C 66.52%, H 7.49%, N 6.29%. Found: C 66.31%, H 7.36%, N 6.07%.

SYNTHESIS 3

α-Pivalyl-α-(4-nitrophthalimido)-5[γ-(2,4-di-tert.-amylphenoxy)butyramido]-2-chloroacetanilide-Coupler (35)

The procedure of Synthesis 2 was repeated except 4.4 g. of 4-nitrophthalimide was used in place of the succinimide and the product was recrystalized from acetonitrile to give 9 g. of the coupler named above.

M.P. 198°-200° C.

Analysis: Calculated for $C_{41}H_{49}ClN_4O_8$: C 64.69%, H 6.44%, N 7.36%. Found: C 64.45%, H 6.59%, N 7.34%.

SYNTHESIS 4

α-Pyvalyl-α-phthalimido-5-[N-{γ-(2,4-di-tert.-amylphenoxy)propyl}sulfamyl]-2-chloroacetanilide-Coupler (9)

Into 400 cc. of acetonitrile were dissolved 32 g. of α-pyvalyl-α-chloro-5-[N-{γ-(2,4-di-tert.-amylphenoxy)propyl}sulfamyl]-2-chloroacetanilide and 8 g. of phthalimide. Into the solution was added 6 g. of triethylamine and the mixture heated under reflux for 8 hours.

After the reaction was completed, about 200 cc. of acetonitrile was distilled off under reduced pressure. Into the residue was added 60 cc. of acetic acid and the mixture added dropwise with stirring into 3 liters of water. The product formed thereby was collected by filtration, dried and recrystallized, first from ligroin and then from methanol. There was obtained 22 g. of the coupler set forth above.

M.P. 172°-173° C.

Analysis: Calculated for $C_{40}H_{50}ClN_3O_7S$: C 63.87%, H 6.65%, N 5.52%. Found: C 63.71%, H 6.65%, N 5.59%.

SYNTHESIS 5

α-Pivalyl-α-phthalimido-5-[α-(2,4-di-tert.-amylphenoxy)butyramido]-2-chloroacetanilide-Coupler (33)

Into 300 cc. of acetonitrile were dissolved 30 g. of α-pivalyl-α-chloro-5-[α-(2,4-di-tert.-amylphenoxy)-butyramido]-2-chloroacetanilide and 7.5 g. of phthalimide. Into the solution was added 5 g. of triethylamine and the mixture was heated under reflux for 8 hours. After the reaction was completed the acetonitrile was distilled off under reduced pressure. The residue was dissolved into 50 cc. of acetic acid and the solution added dropwise with stirring into 1 liter of water. The product formed thereby was collected by filtration dried and recrystallized from n-hexane to obtain 20 g. of the coupler named above.

M.P. 157°-159° C.

Analysis: Calculated for $C_{41}H_{50}ClN_3O_3$: C 68.76%, H 6.99%, N 5.87%. Found: C 68.48%, H 7.01%, N 5.58%.

SYNTHESIS 6

α-Pyvalyl-α-phthalimidoacetanilide Coupler (48)

79 g. of α-pyvalylacetanilide prepared by condensing ethyl pyvalylacetate with aniline was dissolved into 660 ml. of chloroform and the solution kept at a temperature of from 0° to 5° C. Into the solution was added dropwise with stirring a solution of 49 g. of sulfuryl chloride in 100 ml. of chloroform, over a 2 hour period, after which time the mixture was stirred for 30 minutes. Then, the solvent was completely removed by distillation under reduced pressure, and the resulting white solid was recrystallized from ethanol to give α-pivalyl-α-chloroacetanilide as needle-like crystals having a melting point of 154° C.

A mixture consisting of 10.2 g. of α-pivalyl-α-chloroacetanilide, 6.8 g. of phthalimide, 4.3 g. of triethylamine and 100 ml. of acetonitrile was heated under reflux for 24 hours. The needle-like crystals formed upon cooling were recrystallized from acetonitrile to give the coupler named above.

M.P. 229° C.

Analysis: Calculated for $C_{21}H_{20}N_2O_4$: C 69.22%, H 5.53%, N 7.69%. Found: C 68.88%, H 5.46%, N 7.52%.

SYNTHESIS 7

α-Pivalyl-α-(5,5-dimethyl-3-hydantoinyl)-5-[-(2,4-di-tert.-amylphenoxy)butylamido]-2-chloroacetanilide-Coupler (55)

The procedure of Synthesis 2 was repeated except 3.3 g. of 5,5-dimethylhydantoin was used in place of the succinimide and the product was recrystalized from the mixture of ethylacetate and ligroin, to give 11 g. of the coupler named above.

M.P. 138°-140° C.

Analysis: Calculated for $C_{38}H_{53}ClN_4O_6$: C 65.47%, H 7.61%, N 8.05%. Found: C 65.33%, H 7.86%, N 7.80%.

SYNTHESIS 8

α-Pivalyl-α-(5,5-dimethyl-3-hydantoinyl)-5-[γ-(2,4-di-tert.-amylphenoxy)butylamido]-2-methoxyacetanilide-Coupler (57)

The procedure of Synthesis 7 was repeated except 15 g. of α-pivalyl-α-chloro-5-[γ-(2,4-di-tert.-amylphenoxy)butylamido]-2-methoxyacetanilide was used in place of the γ-pivalyl-α-chloro-[γ-(2,4-di-tert.-amylphenoxy)butylamido]-2-chloroacetanilide, and the product was recrystalized from acetonitrile to give 8.5 g. of the coupler named above.

M.P. 159°-160° C.

Analysis: Calculated for $C_{39}H_{56}N_4O_7$: C 67.63%, H 8.09%, N 8.09%. Found: C 67.10%, H 8.01%, N 7.73%.

SYNTHESIS 9

α-Pivalyl-α-(5-isopropyl-3-hydantoinyl)-5-[γ-(2,4-di-tert.-amylphenoxy)butylamido]-2-chloroacetanilide-Coupler (59)

The procedure of Synthesis 2 was repeated except 4 g. of 5-isopropylhydantoin was used in place of the succinimide and the product was recrystalized from methanol, to give 8 g. of the coupler named above.

M.P. 193°-195° C.

Analysis: Calculated for $C_{39}H_{55}ClN_4O_6$: C 65.87%, H 7.74%, N 7.88%. Found: C 66.15%, H 7.78%, N 7.92%.

SYNTHESIS 10

α-Pivalyl-α-(3-uraciloyl)-5-[γ-(2,4-di-tert.-amylphenoxy)-butylamido]-2-chloroacetanilide-Coupler (62)

The procedure of Synthesis 2 was repeated except 3 g. of uracil was used in place of the succinimide and the product was recrystalized from ethylacetate to give 5 g. of the coupler named above.

M.P. 189°-190° C.

Analysis: Calculated for $C_{37}H_{49}ClN_4O_6$: C 65.25%, H 7.20%, N 8.23%. Found: C 65.05%, H. 7.17%, N 8.10%.

The present invention will be further explained in greater detail by reference to the following examples.

EXAMPLE 1

A solution prepared by heating at a temperature of 70° C. a mixture of 27 g. of α-pivalyl-α-phthalimido-2-chloro-5-[α-(2,4-di-tert.-amylphenoxy)butyramido]-acetanilide (Coupler 33), 30 ml. of di-n-butyl phthalate and 50 ml. of cyclohexanone was added into 300 ml. of an aqueous solution containing 30 g. of gelatin and 2.0 g. of sodium dodecylbenzene sulfonate, followed by agitation. The mixture was then, after preheating, passed five times through a colloid mill, thereby giving a finely emulsified dispersion of the coupler together with the solvent.

All of the emulsified dispersion was then added into 1.0 kg. of a photographic emulsion containing 54 g. of silver iodobromide and 60 g. of gelatin, after which 30 ml of a 3% acetone solution of triethylene phosphamide was added as a hardener. The pH of the mixture was then adjusted to 6.0 and the mixture was applied onto a cellulose triacetate film base to give a dry thickness of 7.0 microns. The resulting coated film is hereinafter referred to as "Film A". This film was found to contain $2.06\times10^{-3}$ mole of coupler per square meter.

For comparison, another film was prepared using the same procedure as described above except that there was used, in place of the Coupler (33), 21.6 g. of α-pivalyl-2-chloro-5-[α-(2,4-di-tert.-amylphenoxy)-butyramido]-acetanilide Coupler (a), a compound which corresponds to the Coupler (33) with the exception that the coupling position thereof is not substituted. The resulting film is hereinafter referred to as "Film B".

These films were then subjected to sensitometric step-wise exposure followed by processing in the following sequence.

| | | |
|---|---|---|
| 1. Color Development | 20° C. | 15 min. |
| 2. Washing | 18 | 1 |
| 3. First Fixing | 20 | 4 |
| 4. Washing | 18 | 3 |
| 5. Bleach | 20 | 5 |
| 6. Washing | 18 | 3 |
| 7. Second fixing | 20 | 3 |
| 8. Washing | 18 | 15 |

The composition of the color developer used herein was as follows:

| Color Developer A | |
|---|---|
| 4-Amino-3-methyl-N,N—diethylaniline Hydrochloride | 2.5 g. |
| Sodium Sulfite (anhydrous) | 3.0 g. |
| Sodium Carbonate (monohydrate) | 47.0 g. |
| Potassium Bromide | 2.0 g. |
| Water to make | 1,000 ml. |

The fixing solution used was an aqueous acidic solution containing sodium thiosulfate and sodium sulfite, and the bleaching solution used was a neutral solution containing potassium ferricyanide and potassium bromide.

After the processing, these film specimens were measured for their optical density to blue light, thereby giving the following photographic characteristics as shown in Table 1 below. The resulting color images, in either case, were of sharp yellow having the absorption maximum at 449 mμ.

TABLE 1

| Film Specimen | Coupler | Photographic Characteristics: Fog | Sensitivity* (relative value) | Gamma | Maximum Density |
|---|---|---|---|---|---|
| A | (33) | 0.20 | 100 | 2.23 | 3.06 |
| B | (a) | 0.11 | 95 | 0.65 | 1.87 |

*Amount of exposure required to give a density 0.10 unit above the value at which fog occurs.

The maximum densities are shown in the following Table 2, which were obtained upon processing for different periods of developing time.

TABLE 2

| Film Specimen | Coupler | Maximum Densities (to blue light) Developing Time (min.) 5 | 10 | 15 | 20 |
|---|---|---|---|---|---|
| A | (33) | 2.42 | 3.07 | 3.06 | 3.04 |
| B | (a) | 0.91 | 1.53 | 1.87 | 2.06 |

These results show that the imido group containing the coupler according to the invention can give higher sensitivity, gradation and color density, in comparison with those of the non-substituted coupler and also give sufficient color image formation within a short period of time, thus making it possible to shorten the processing time. Such results also indicate that the couplers substituted by an imido group have a higher coupling activity than unsubstituted couplers.

In order to confirm this improved coupling reactivity the following experiment was carried out.

Yellow color forming couplers (2) and (a) each was admixed with a cyan forming coupler (b), i.e., 4,6-dichloro-5-methyl-2-[α-2,4-di-tert.-amylphenoxy]-acetamido-phenol in a molar ratio of 2:1 and color development, using 4-amino-3-methyl -N,N-diethylaniline was carried out. The analysis of the ratio of the formed yellow dye to the cyan dye, from which the relative value, based upon the cyan forming coupler (b), of the reaction rate constant in the coupling reaction of the yellow forming coupler was calculated. The relative value of the reaction rate constant was determined (See Ser. No. 206,060, filed Dec. 8, 1970) by measuring the amounts of two colors in the color images obtained by mixing two couplers A and B which give clearly separated different colors and adding the mixture to an emulsion, and then performing color development. If coupler A develops color of the maximum density $(D_A)_{max}$ and color of density $D_A$ in an intermediate stage, and coupler B develops colors of $(D_B)_{max}$ and $D_B$ respectively, the ratio $R_A/R_B$ of the reaction activities of both couplers is expressed by the following equation.

$$\log\left(1-\frac{D_A}{(D_A)_{max}}\right)/\log\left(1-\frac{D_B}{(D_B)_{max}}\right)=R_A/R_B$$

In other words, the coupling activity ratio $R_A/R_B$ can be obtained from the gradient of the straight line which is obtained by plotting several sets of $D_A$ and $D_B$ resulting from imparting several stages of exposure to an emulsion containing a mixed coupler and subjecting them to color development, on two axes crossing at right angles to each other as log $(1-D/D_{max})$. The imide group containing Coupler (33) gave a relative rate constant of 3.1, while the heretofore known unsubstituted coupler (a) gave a relative rate constant of 0.32. Thus, the reactivity was improved 10 times with the coupler of the imido type used according to the invention, in comparison with the heretofore known unsubstituted coupler.

EXAMPLE 2

Each of Films A and B prepared in Example 1 was subjected to sensitometric stepwise exposure and then processed through the following steps.

| | | |
|---|---|---|
| 1. Color Development | 24° C. | 8 min. |
| 2. Stop | 24 | 2 |
| 3. Blix | 24 | 6 |
| 4. Wash with water | 24 | 5 |

The color developer used was of the same composition as described in Example 1 and the other processing baths used were each of the following composition:

| Composition of Stopping Bath | |
|---|---|
| Sodium Sulfite (anhydrous) | 5.0 g. |
| Glacial Acetic Acid | 15.0 ml. |
| Water to make | 1,000 ml. |

| Composition of Blix Bath | |
|---|---|
| Ammonium Thiosulfate | 105.0 g. |
| Sodium Sulfite | 8.0 g. |
| Sodium Hydroxide | 18.0 g. |
| EDTA Disodium Salt | 35.0 g. |
| Ferric Chloride (hexahydrate) | 25.0 g. |
| Potassium Thiocyanate | 10.0 g. |
| Water to make | 1,000 ml. |

After processing, these film specimens were measured for their optical density to blue light, and then dipped in a 1.5% aqueous solution of potassium ferricyanide for 2 minutes at a temperature of 24° C., washed with water for 10 minutes and dried, followed by second measurement for their optical density to blue light, the results being shown in the following Table 3.

TABLE 3

| Film Specimen | Coupler No. | Photographic Characteristics: Before Treatment with Potassium Ferricyanide Solution: Fog | Gamma | Maximum Density | After Treatment with Potassium Ferricyanide Solution: Fog | Gamma | Maximum Density |
|---|---|---|---|---|---|---|---|
| A | (33) | 0.19 | 2.25 | 3.09 | 0.19 | 2.25 | 3.11 |
| B | (a) | 0.10 | 0.37 | 1.00 | 0.11 | 0.71 | 1.95 |

As is evident from the results contained in the above-described table, when the imido group containing Coupler (33) according to the invention is used, color image formation is completed in the color-development and blix steps, whereas, when the prior art non-substituted Coupler (a) is used, only a half of the color image formation is completed with another half of the reaction products remaining colorless, and, in order to completely convert the colorless reaction products to the dye, an after-treatment using a stronger oxidizing agent is necessary. Thus, it has been clearly shown that the novel imido-substituted yellow forming coupler of the invention can shorten markedly the time for the color development process.

EXAMPLE 3

A solution prepared by heating on a steam bath a mixture of 57.1 g. of α-pivalyl-α-(4'-nitrophthalimido)-2-chloro-5-[γ-(2,4-di-tert.-amylphenoxy)-butyramido]-acetanilide (Coupler 35), 55 ml. of tri-n-hexyl phosphate and 150 ml. of methylcyclohexanone was added into 700 ml. of an aqueous solution containing 50 g. of gelatin and 3.0 g. of sodium cetyl sulfate with stirring, followed by vigorous mechanical agitation for 30 minutes using a high speed agitator, thereby finely dispersing the coupler together with the solvent.

All of this emulsified dispersion was then added into 1.5 kg. of a photographic emulsion containing 0.301 mol. of silver chlorobromide and 100 g. of gelatin, after which 15 ml. of a 4% aqueous solution of the sodium salt of 1-hydroxy-3,5-dichloro-3-triazine as a hardener was added. The mixture was then adjusted to a pH of 6.2 and applied, to a dry thickness of 3.0 microns, onto a baryta-coated paper, both surfaces of which were resin-coated with polyethylene. The resulting coated film is hereinafter referred to as "Film C". This specimen was found to contain $1.00\times10^{-3}$ mole of coupler per square meter.

For comparison, another film (hereinafter referred to as Film D) was prepared by following the same procedure as described above except that there was used, in place of the Coupler (35), 43 g. of a Coupler (a) the coupling position of which is not substituted (i.e. α-pivalyl-2-chloro-5-[γ-(2,4-di-tert.-amylphenoxy)-butyramido]-acetanilide. This specimen had an emulsion layer of 3.0 microns in thickness and contained $1.06\times10^{-3}$ mole of coupler per square meter.

Using 43 g. of Coupler (a), there was prepared an emulsified dispersion of the coupler in the same manner as described above. All of this emulsified dispersion was added into 3.0 kg. of a photographic emulsion containing 0.602 mole of silver chlorobromide and 200 g. of gelatin, after which 25 ml. of a 4% aqueous solution of the sodium salt of 1-hydroxy-3,5-dichloro-s-triazine was added as a hardener. The mixture was then adjusted to a pH of 6.2 and applied in the same manner as described above to obtain a "Specimen E". The specimen had an emulsion layer of 4.0 microns thickness and contained $1.02\times10^{-3}$ mole coupler per square meter.

The emulsions used to prepare these specimens were obtained by dividing the same silver chlorobromide emulsion and optionally diluting with an aqueous gelatin solution. These specimens contain approximately the same amounts of coupler and different amounts of silver.

These specimens were subjected to sensitometric stepwise exposure and then processing in the same manner as described in Example 1 except that color development was carried out at a temperature of 24° C. for 12 minutes using the following color developer.

| Color Developer B | |
|---|---|
| Benzyl Alcohol | 12.0 ml. |
| Sodium Hexametaphosphate | 2.0 g. |

-continued

| Color Developer B | |
|---|---|
| Sodium Sulfite (anhydrous) | 2.0 g. |
| Sodium Carbonate (monohydrate) | 27.5 g. |
| Hydroxylamine Sulfate | 2.5 g. |
| 4-Amino-3-methyl-N—(β-methane-sulfonamidoethyl) aniline Sesquisulfate (monohydrate) | 4.0 g. |
| Water to make | 1,000 ml. |

After the processing, these specimens were measured for their reflection density against blue light, the results of which are shown in the following Table 4.

TABLE 4

| | | Photographic Characteristics | | | | |
|---|---|---|---|---|---|---|
| Specimen | Coupler | Molar Ratio of Silver Halide to Coupler | Fog | Sensitivity* (relative value) | Gamma | Maximum Density |
| C | (35) | 4 | 0.14 | 100 | 1.63 | 1.44 |
| D | (a) | 4 | 0.11 | 95 | 0.47 | 1.08 |
| E | (a) | 8 | 0.14 | 95 | 0.64 | 1.30 |

From the results contained in above-described table, it is evident that Coupler (35) according to the invention can produce a higher color density even when used with a smaller amount of silver halide, incomparison with the corresponding non-substituted Coupler (a) and, moreover, the thickness of the emulsion layer can be reduced.

EXAMPLE 4

Solutions prepared by heating on a hot plate mixtures of $5\times10^{-3}$ mole of various couplers each shown by the hereinbefore-described formulas and designated in the hereinafter described Table 5, 4.5 ml. of di-n-butyl phthalate, 8 ml. of cyclo-hexanone and 0.2 g. of the sodium salt of bis-(2-ethylhexyl)-α-sulfosuccinate were each poured into 60 ml. of an aqueous solution containing 5 g. of gelatin and vigorously mechanically agitated in a homo-blender, thereby finely dispersing the coupler.

All of each coupler dispersion was then added into 150 g. of an emulsion containing 3.8 g. of fine grain silver bromide and 13 g. of gelatin and applied onto a cellulose triacetate film base to give a dry thickness of 7 microns.

Each film thus obtained was then subjected to exposure to light and developed in the same manner as described in Example 1 to obtain a yellow dye image. The spectral absorption characteristics of the respective yellow dye images was measured, using a spectrophotometer, to give the absorption maxima of each shown in the following table.

TABLE 5

| | λmax. of the Yellow Dye Images | | |
|---|---|---|---|
| Coupler | λmax. (mu) | Coupler | λmax. (mu) |
| (1) | 442 | (26) | 455 |
| (2) | 449 | (27) | 454 |
| (3) | 450 | (28) | 450 |
| (4) | 446 | (29) | 448 |
| (5) | 445 | (30) | 450 |
| (7) | 449 | (31) | 459 |
| (8) | 441 | (32) | 452 |
| (9) | 458 | (33) | 449 |
| (10) | 440 | (34) | 451 |

TABLE 5-continued

| λmax. of the Yellow Dye Images | | | |
|---|---|---|---|
| Coupler | λmax. (mu) | Coupler | λmax. (mu) |
| (11) | 446 | (35) | 450 |
| (12) | 448 | (36) | 458 |
| (13) | 446 | (37) | 450 |
| (14) | 455 | (38) | 455 |
| (15) | 449 | (39) | 451 |
| (16) | 448 | (40) | 452 |
| (17) | 446 | (41) | 454 |
| (18) | 459 | (43) | 449 |
| (19) | 450 | (44) | 449 |
| (20) | 451 | (45) | 448 |
| (21) | 457 | (46) | 449 |
| (22) | 455 | | |

EXAMPLE 5

A solution prepared by heating and dissolving at a temperature of 60° C. a mixture of 26.7 g. of α-pivalyl-α-succinimido-2-chloro-5-{γ-(2,4-di-tert.-amylphenoxy)butylamido}-acetanilide Coupler (30), 20 ml. of di-n-butyl phthalate and 55 ml. of cyclohexanone was added with stirring into 400 ml. of an aqueous solution containing 4.0 g. of the sodium salt of di-(2-ethylhexyl)-α-sulfosuccinate and 36 g. of gelatin and the resulting emulsified dispersion was passed twice through a milk-homogenizer, thereby finely emulsifying the coupler with the solvent.

All of this emulsified dispersion was then admixed with 700 g. of a photographic emulsion containing 22.6 g. of silver iodobromide (iodide content 2 mole %) and 50 g. of gelatin, after which 20 ml. of a 3% acetone solution of triethylene phosphamide was added as a hardener. The mixture was then adjusted to a pH of 6.5 and applied to dry thickness of 3.5 microns onto a baryta-coated paper, both surfaces of which had been resin-coated with polyethylene.

On top of the resulting coating, was applied a gelatin solution at a dry thickness of 1.0 micron to form a second layer.

A green-sensitive silver halide emulsion containing a magenta forming Coupler (c) of the structure shown below was then applied to give a dry thickness of 3.5 microns and form a third layer Coupler (c)

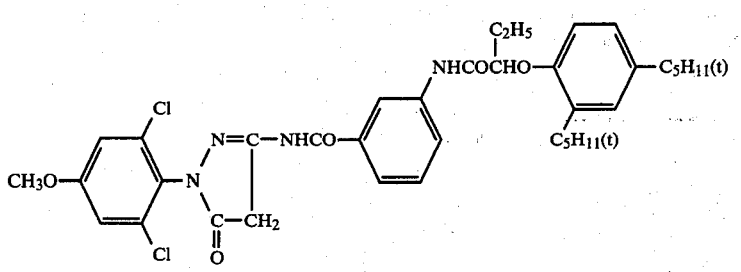

In the same manner, a gelatin solution containing 2-(2'-benzotriazoyl)-4,6-dibutylphenol as an ultraviolet absorbing agent was then applied at a dry thickness of 2.5 microns to form a fourth layer. A red-sensitive silver halide emulsion containing a cyan forming Coupler (d) of the structure shown below was applied at a dry thickness of 4.0 microns to form a fifth layer and finally a gelatin solution was applied to dry thickness of 0.5 micron to form the uppermost layer, thereby giving a Color Printing Paper.

Coupler (d)

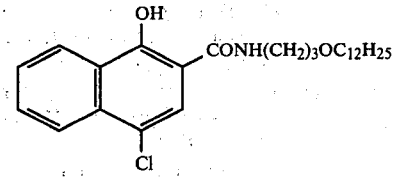

This Color Print Paper was optically printed with the aid of a color negative and processed with the Color Developer B and a blix solution in the same manner as described in Example 2. The resulting color print has a clear color and showed excellent color-reproducibility. Particularly, the freedom in the yellow color from any red tint was marked. The yellow dye image had an absorption maximum at 445 millimicrons.

This color print was directly exposed to sun light for 5 days, but, the density decrease for the yellow dye image in the area of 1.0 initial reflection density was only 0.03. When it was stored at high temperature and humidity conditions, i.e. at 60° C. under a relative humidity of 75%, for 2 weeks, no substantial decrease in the density was observed.

EXAMPLE 6

A solution prepared by heating on a steam bath a mixture of 28 g. of α-pivalyl-α-phthalimido-5-[N-{γ-(2,4-di-tert.-amylphenoxy)propyl}sulfamyl]-2-chloroacetanilide, Coupler (9), 44 ml. of tris (2-ethylhexyl) phosphate, 1.2 g. of 2,5-dioctylhydroquinone and 55 ml. of cyclohexanone was added with stirring into 400 ml. of an aqueous solution containing 2.0 g. of sodium p-dodecylbenzene sulfonate and 30 g. of gelatin, and the resulting emulsified dispersion was passed five times through a preheated colloid mill, thereby finely dispersing the coupler with the solvent.

All the emulsified dispersion was admixed with 570 g. of a photographic emulsion containing 27.5 g. of silver iodobromide and 42 g. of gelatin, and 15 ml. of a 3% acetone solution of triethylene phosphamide was added as a hardener, after which the mixture was adjusted to a pH of 6.0 to complete the preparation of a blue-sensitive emulsion.

Over a polyethylene telephthalate film base, there were coated, as a first layer, a gelatin solution containing a black silver colloid at a dry thickness of 2.5 microns, for antihalation purposes; as a second layer, a red-sensitive silver halide emulsion containing 4,6-dichloro-3-methyl-2-[α-(2,4-di-tert.-amylphenoxy)-acetamido]-phenol (cyan forming Coupler (b)) at a dry thickness of 4.5 microns; as a third layer, a gelatin solution containing 2,5-di-tert.-octylhydroquinone at a dry thickness of 1.5 microns; as a fourth layer, a green sensitive silver halide emulsion containing the magenta forming Coupler (c) at a dry thickness of 4.5 microns; and as a fifth layer, a gelatin layer containing a yellow colloidal silver at a dry thickness of 2.0 microns. Over the fifth layer, there was applied a blue-sensitive emulsion at a dry thickness of 5.0 microns, on which emulsion layer was coated a gelatin protective layer as the uppermost layer at a dry thickness of 1.0 micron, thereby giving a complete color film.

This film was exposed to light and subjected to color development using the following process.

| | | |
|---|---|---|
| 1. First Development | 21° C. | 5 min. |
| 2. Wash with Water | 18 | 10 |
| 3. Uniform Exposure | | |
| 4. Second Development (Color Development) | 21° C. | 12 min. |
| 5. Stop | 21 | 2 |
| 6. Blix | 21 | 8 |
| 7. Wash with Water | 18 | 10 |

As the second developer and blix solution, there were used Color Developer B of Example 3 and the blix solution of Example 2, respectively. As the first developer, there was used a black and white developer of the following composition.

| Developer C | |
|---|---|
| p-N—Methylaminophenol | 0.3 g. |
| Sodium Sulfite (anhydrous) | 38.0 g. |
| Sodium Carbonate (monohydrate) | 22.5 g. |
| Potassium Bromide | 0.9 g. |
| Citric Acid | 0.7 g. |
| Potassium Thiocyanate | 1.0 g. |
| Water to make | 1 liter |

The reversal color image thus obtained was sharp and clear, indicative of excellent color-reproducibility. In this example, the sharpness in the resulting image was particularly excellent because the blue-sensitive emulsion layer could be extremely thin.

EXAMPLE 7

A silver iodobromide emulsion (iodide content 2 mole %) was applied onto a film support at a dry thickness of 5 microns and at a silver coating amount of 150 micrograms/cm$^2$. The coated film was subjected to sensitometric stepwise exposure, and developed at a temperature of 24° C. for 8 minutes using the following developer, after which it was fixed, bleached, fixed and washed with water to obtain a yellow dye image.

| Color Developer D | |
|---|---|
| Water | 950 ml. |
| Sodium Sulfite (anhydrous) | 1.0 g. |
| 4-Amino-3-methyl-N,N—diethylaniline Hydrochloride | 2.0 g. |
| Sodium Carbonate (monohydrate) | 22.5 g. |
| Potassium Bromide | 1.0 g. |
| α-Pivalyl-α-phthalimido-acetanilide Coupler (48) | 2.0 g. |
| Acetone | 25.0 ml. |
| 8% Aqueous Solution of Sodium Hydroxide | 25.0 ml. |

The dye image had an absorption maximum at 449 millimicrons.

EXAMPLE 8

A solution prepared by heating on a steam bath of a mixture of 26.0 g. of α-pivalyl-α-(5,5-dimethyl-3-hydantoinyl)-5-{γ-(2,4-di-tert.-amylphenoxy)-butyramido}-2-chloroacetanilide-Coupler (55), 25 ml. of di-n-butyl phthalate and 50 ml. of ethyl acetate was added into 300 ml. of an aqueous solution preheated to 40° C. containing 30 g. of gelatin and 2.0 g. of sodium p-dodecylbenzene sulfonate with stirring, followed by mechanical agitation. The mixture was then passed five times through a colloid mill, thereby giving a finely emulsified dispersion of said coupler together with the solvent.

All of the emulsified dispersion was then added into 1.0 kg. of a photographic emulsion containing 0.30 mole of silver chlorobromide and 85 g. of gelatin, after which 20 ml. of a 3% acetone solution of triethylene phosphamide was added as a hardener. The pH of the mixture was then adjusted to 6.5 and the mixture was applied onto a cellulose triacetate film base to give a dry thickness of 7.0 microns. This film was found to contain $1.86\times10^{-3}$ mole coupler per square meter. ("Film F")

For comparison, another finely emulsified dispersion was prepared by following the same procedure as described above except that there were used, in place of the Coupler (55), 21.4 g. of α-pivalyl-2-chloro-5-[α-(2,4-di-tert.-amylphenoxy)-butyramido]-acetanilide (Coupler (a)) which corresponds to the Coupler (55) with the exception that the coupling position thereof is not substituted, 20 ml. of di-n-butyl phthalate and 40 ml. of ethyl acetate.

All of this emulsified dispersion was added into 1.0 kg. of a photographic emulsion containing 0.30 mole of silver chlorobromide and 95 g. of gelatin, after which 20 ml. of a 3% acetone solution of triethylene phosphamide was added as a hardener. The pH of mixture was then adjusted to 6.5 and the mixture was applied onto a cellulose triacetate film base to give a dry thickness of 7.0 microns. This film was found to contain $1.90\times10^{-3}$ mole coupler per square meter. ("Film G")

The emulsions used to prepare these specimens were obtained by dividing the same silver chlorobromide emulsion and optionally diluting with an aqueous gelatin solution.

These specimens were subjected to sensitometric stepwise exposure and then processed in the same manner as in Example 1 except that color development was carried out at 24° C. for 12 minutes using Color Developer B as described in Example 3.

After processing, these specimens were measured for their optical density to blue light, thereby giving the following photographic characteristics as shown in the following Table 6.

TABLE 6

| Film Specimen | Coupler | Photographic Characteristics: Fog | Sensitivity* | Gamma | Maximum Density |
|---|---|---|---|---|---|
| F | 55 | 0.12 | 100 | 1.55 | 2.10 |
| G | (a) | 0.07 | 96 | 0.48 | 1.41 |

The maximum densities which are obtained upon processing for differing periods of developing time are shown in the following table.

TABLE 7

| Film Specimen | Coupler | Maximum Densities (to blue light) Developing Time 4 | 8 | 12 | 16 |
|---|---|---|---|---|---|
| F | 55 | 1.74 | 2.11 | 2.10 | 2.08 |
| G | (a) | 0.66 | 1.10 | 1.41 | 1.67 |

These results show that the imido group containing coupler according to the invention can give higher sensitivity, gradation and color density, in comparison with those of the non-substituted coupler and also give sufficient color image formation within a short period of time.

COMPARATIVE EXPERIMENT

A solution prepared by heating and dissolving at a temperature of 60° C. a mixture of 5.0 g. of α-pivalyl-α-phthalimido-2-chloro-5[γ-(2,4-di-tert.-amylphenoxy)-butyramido]-acetanilide Coupler (2), 5.0 ml. of di-n-butyl phthalate and 10.0 ml. of cyclohexanone was added into 70 ml. of an aqueous solution containing 5 g. of gelatin and 0.7 g. of sodium p-dodecylbenzene sulfonate followed by vigorous agitation in a homo-blender to disperse the coupler.

All the emulsified dispersion was added into 200 g. of a photographic emulsion containing 10.5 g. of silver bromide and 17 g. of gelatin, and 6 ml. of a 3% acetone solution of triethylene phosphamide. The mixture was adjusted to a pH of 6.0 and then applied onto a cellulose triacetate film base at a dry thickness of 7.0 microns (Film H).

For comparison, a film Film I was prepared by following the same procedure as described above except that there was used, in place of Coupler (2), a Coupler (e) which corresponds to Coupler (2) with the exception that the coupling position thereof it not substituted, i.e. α-pivalyl-2-chloro-5-[γ-2,4-di-tert.-amylphenoxy)-butyramido]-acetanilide.

These films were exposed to sensitometric stepwise exposure, developed at a temperature of 20° C. for 15 minutes using the developer of Example 1, washed with water for 1 minute, fixed for 4 minutes, washed with water for 10 minutes and then dried. The amount of silver at each exposure level was measured by the fluorescent X-ray method. They were then bleached with potassium ferricyanide, fixed, washed with water and then dried. The color developed films thus obtained were then dipped in N,N-dimethylformamide containing 15%, by volume, of water for 48 hours to extract the color forming dyes and the absorbance of the solutions were measured. The quantity of the dye in the respective solutions was determined by means of the molecular absorption coefficient ($1.80\times10^4$ l./mol.cm. (25° C.)) of the azomethine dye in the same solvent which has been separately synthesized by the oxidative coupling reaction of α-pivalyl-2-chloro-5-acylaminoacetoanilide with 4-amino-3-methyl-N,N-diethylaniline, and the developed silver to dye molar ratio was calculated. (The reason why the oxidation process was employed after quantitative measurement of silver is that the non-substituted control Coupler (e) is insufficiently developed by the color development process and cannot possibly be directly compared with the couplers of the invention, it being, therefore, necessary to completely form the dye by further oxidation. Without this oxidation process, the above-described molar ratio for the nonsubstituted control Coupler (e) would become approximately twice, although there would be no substantial change in result for the α-diacetylamino substituted Coupler (2) of the invention.)

In the appended drawing, the developed silver to dye molar ratio (equivalent ratio in the color developing reaction) units are given along the ordinate and the quantity of the silver formed by the color developing reaction per unit area (in mole/cm$^2$) along the abscissa. Curve 1 is for Coupler (2) and Curve 2 for the Control Coupler (e). From these data, it has been proved that dye image formation according to the invention requires approximately one half of the silver formation necessary in the case of the non-substituted control coupler and that the α-diacetylamido substituted, yellow forming coupler can be developed substantially by 2 equivalents of an oxidizing agent.

The invention has been described in detail with particular reference to preferred embodiments thereof, but, it will be understood that variations and modifications can be effected without departing from the spirit and scope of the invention described hereinabove and in the appended claims.

What is claimed is:

1. A silver halide emulsion containing a yellow dye-forming coupler of the formula

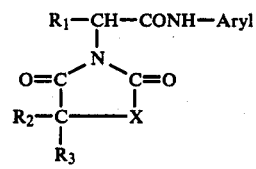

wherein X is oxygen or sulfur, $R_1$ is α-pivalyl, and $R_2$ and $R_3$ are each hydrogen or alkyl.

2. A silver halide emulsion containing a yellow dye-forming coupler of the formula

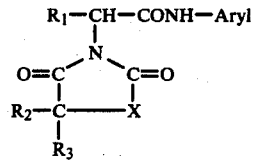

wherein X is oxygen, $R_1$ is α-pivalyl, and $R_2$ and $R_3$ are each hydrogen or alkyl.

3. A silver halide emulsion containing a yellow dye-forming coupler of the formula

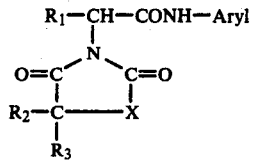

wherein X is sulfur, $R_1$ is α-pivalyl, and $R_2$ and $R_3$ are each hydrogen or alkyl.

4. A silver halide emulsion containing a yellow dye-forming coupler selected from the group consisting of:

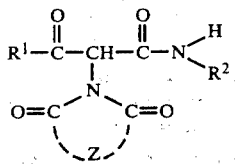

(I)

wherein $R^1$ is an alkyl or alkenyl group, $R^2$ is an aryl group or heterocyclic group and wherein said group

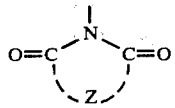

(II)

is

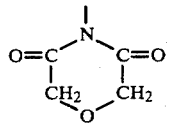

or

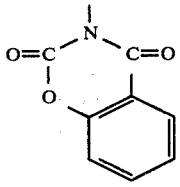

; and

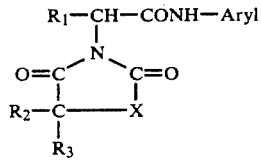

wheren X is oxygen or sulfur, $R_1$ is α-pivalyl and $R_2$ and $R_3$ are each hydrogen or alkyl.

5. The emulsion of claim 4, wherein said yellow dye-forming coupler is of general formula (I) and wherein

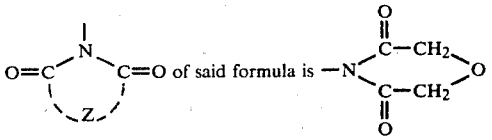

6. The emulsion of claim 4, wherein said yellow dye-forming coupler is of formula (I) and wherein

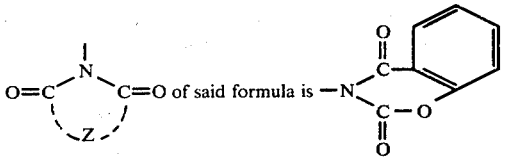

7. The emulsion of claim 4, wherein said yellow dye-forming coupler is of formula (II) and has the formula

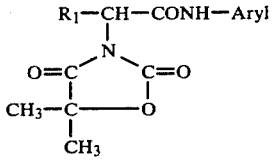

8. A photographic silver halide light-sensitive emulsion containing a yellow dye-forming coupler having the formula

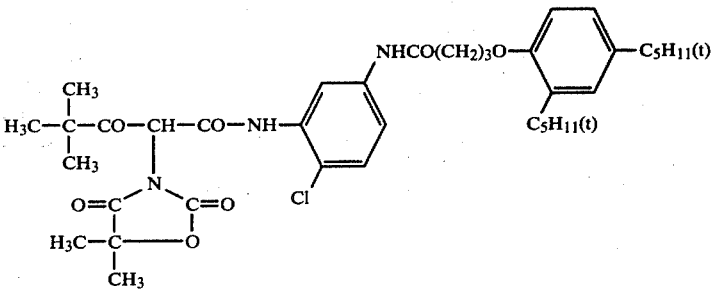

9. A photographic silver halide light-sensitive emulsion containing a yellow dye-forming coupler having the formula

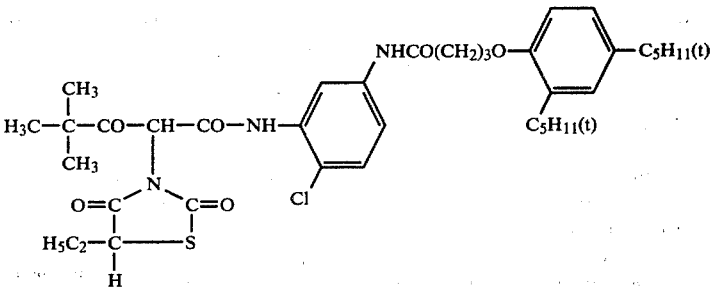

10. A photographic silver halide light-sensitive emulsion containing a yellow dye-forming coupler having the formula

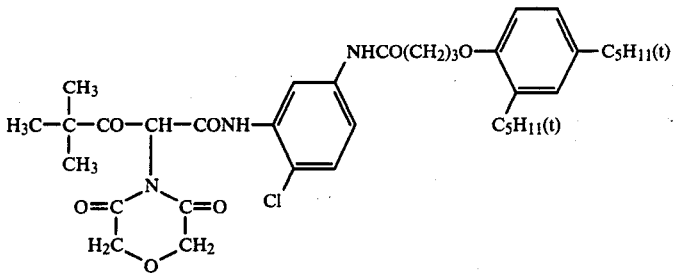

11. A photographic silver halide light-sensitive emulsion containing a yellow dye-forming coupler having the formula

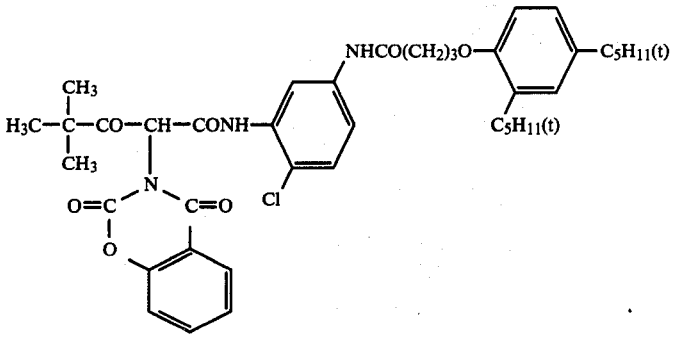

12. A photographic silver halide light-sensitive element comprising a support having coated thereon at least one silver halide emulsion layer containing a yellow dye-forming coupler selected from the group consisting of:

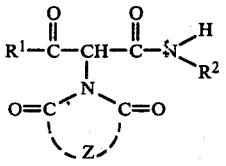

(I)

wherein $R^1$ is an alkyl or alkenyl group, $R^2$ is an aryl group or heterocyclic group and wherein said group

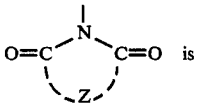

(II)

is

-continued

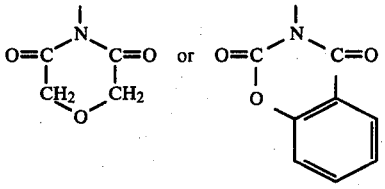

or

; and

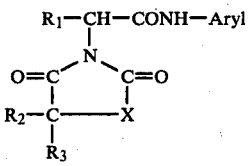

wheren X is oxygen or sulfur, $R_1$ is α-pivalyl and $R_2$ and $R_3$ are each hydrogen or alkyl.

13. The element of claim 12, wherein said yellow dye-forming coupler has the formula

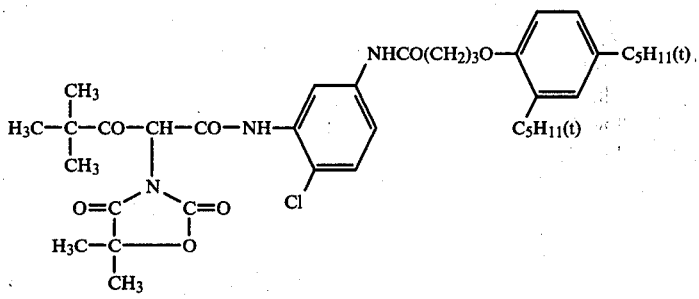

14. The element of claim 12, wherein said yellow dye-forming coupler has the formula

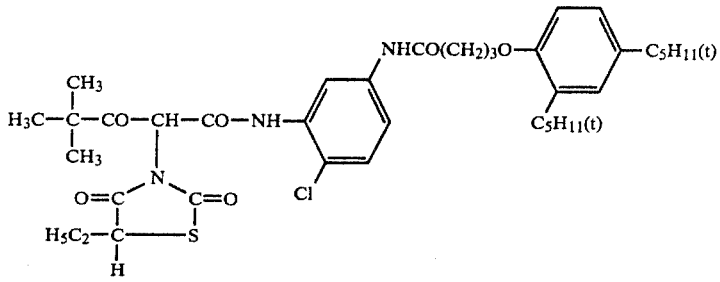

15. The element of claim 12, wherein said yellow dye-forming coupler has the formula

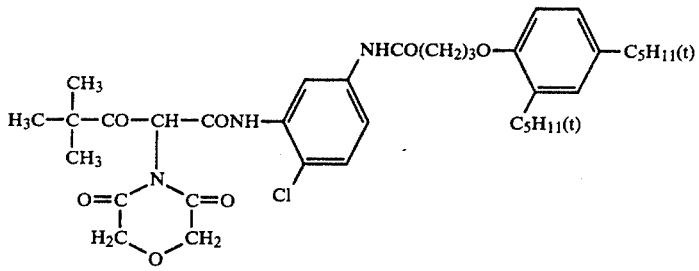

16. The element of claim 12, wherein said yellow dye-forming coupler has the formula

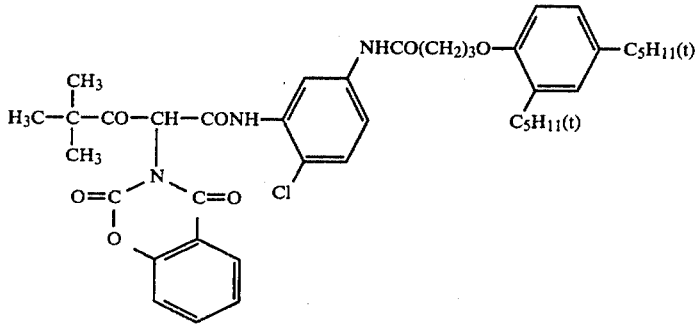

17. The element of claim 12, wherein said yellow dye-forming coupler has formula (II).

18. The element of claim 17, wherein X is oxygen.

19. The elment of claim 17, wherein X is sulfur.

20. The element of claim 12, wherein

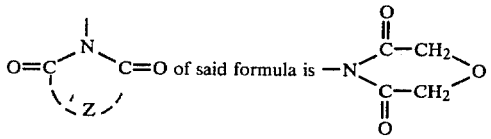

21. The element of claim 12, wherein

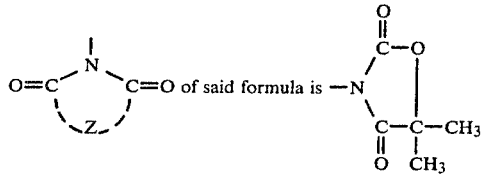

22. The element of claim 12, wherein

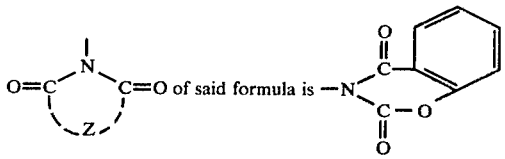

23. A method for forming dye images which comprises processing a silver halide photographic emulsion with an aromatic primary amino developing agent in the presence of a yellow dye-forming coupler selected from the group consisting of:

(I)

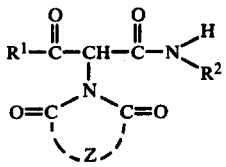

wherein $R^1$ is an alkyl or alkenyl group, $R^2$ is an aryl group or heterocyclic group and wherein said group (II)

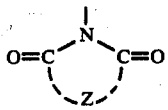

is

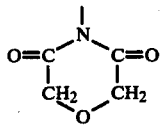

or

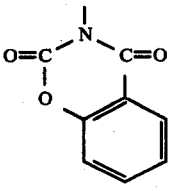

; and

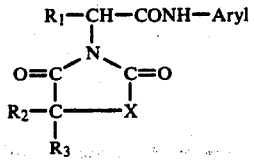

wherein X is oxygen or sulfur, $R_1$ is α-pivalyl and $R_2$ and $R_3$ are each hydrogen or alkyl.

24. The method of claim 23, wherein said group

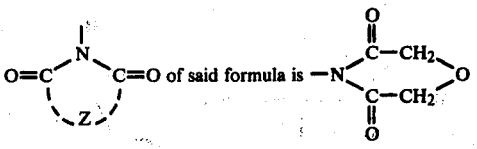

of said formula is

25. The method of claim 23, wherein said group

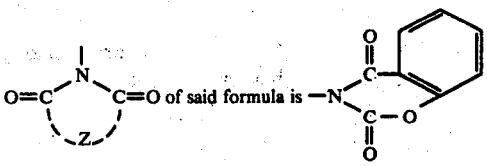

of said formula is

26. The method of claim 23, wherein the yellow dye-forming coupler is of general formula (II) and has the following formula

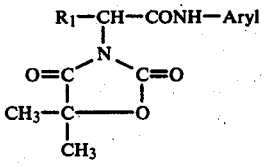

27. The method of claim 23, wherein said yellow dye-forming coupler has the formula

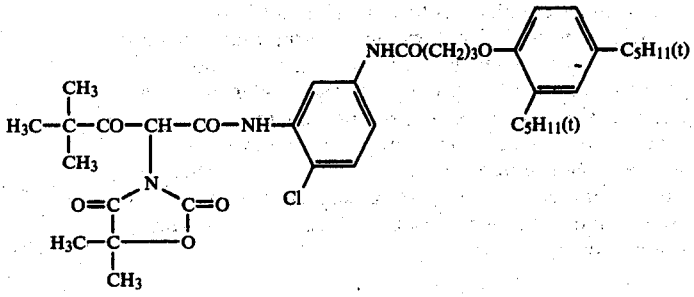

28. The method of claim 23, wherein said yellow dye-forming coupler has the formula

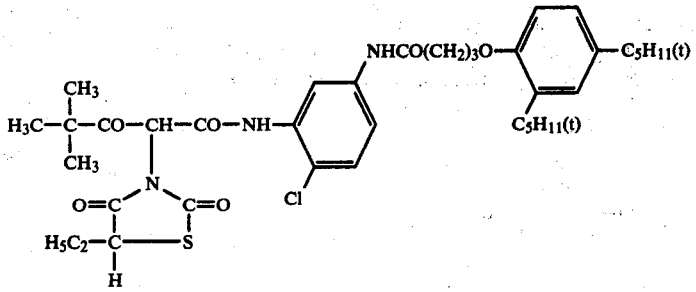

29. The method of claim 23, wherein said yellow dye-forming coupler has the formula

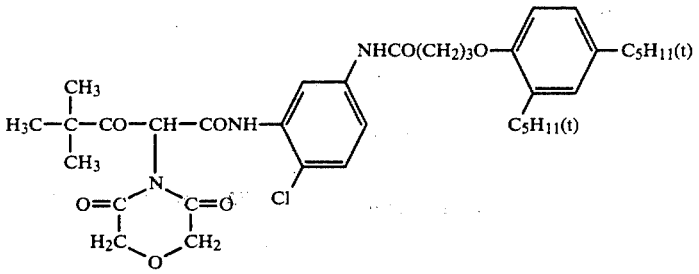

30. The method of claim 23, wherein said yellow dye-forming coupler has the formula

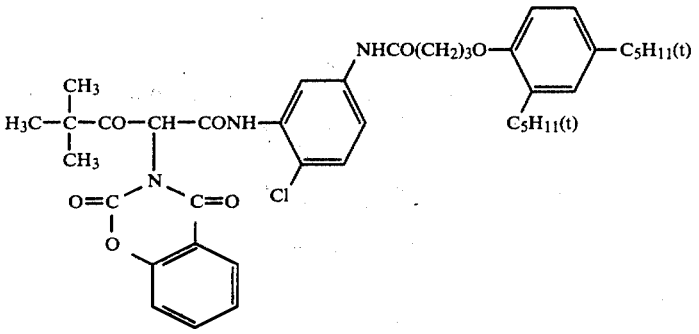

31. The method of claim 23, wherein said yellow dye-forming coupler has formula (II).

32. The method of claim 23, wherein said yellow dye-forming coupler has formula (II) and X is oxygen.

33. The method of claim 23, wherein said yellow dye-forming coupler has formula (II) and X is sulfur.

34. A method for forming photographic images which comprises image-wise exposing a photographic element, developing said photographic element in an aqueous alkaline processing solution containing an aromatic primary amino developing agent and bleach-fixing said photographic element, said photographic element comprising a support having coated thereon a silver halide emulsion containing a yellow dye-forming coupler of the formula

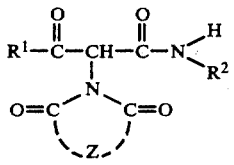

(I)

wherein $R^1$ is an alkyl group or an alkenyl group, $R^2$ is an aryl group or a heterocyclic group, and Z is the non-metallic atoms necessary to form with the

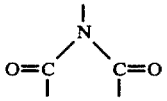

moiety in said general formula, a 5-membered or a 6-membered ring.

35. The method of claim 34, wherein at least one of $R^1$, $R^2$ and Z contains as a substituent a hydrophobic residual group of from about 8 to about 32 carbon atoms.

36. The method of claim 34, wherein said coupler has the general formula

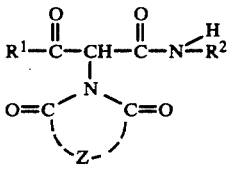

wherein $R^1$ represents an alkyl, an alkenyl, a cycloalkyl, an aralkyl, an alkylcycloalkyl, an aryloxyalkyl, an alkoxyalkyl, a haloalkyl, a furyl or a norbornyl group; wherein $R^2$ represents (1) a monovalent phenyl group; (2) a monovalent substituted phenyl group, wherein said substituents are halogen atoms, alkyl groups, alkenyl groups, alkoxy groups, aryl groups, aryloxy groups, carbonyl groups, sulfonyl groups, carboxyl groups, alkoxy carbonyl groups, carbamyl groups, sulfone groups, sulfamyl groups, acylamino groups, ureido groups, sulfonamide groups, amino groups, nitro groups, cyano groups and hydroxyl groups; (3) a monovalent heterocyclic group bound to said

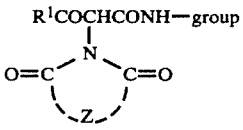

in the general formula through a carbon atom in said heterocyclic group which is part of a conjugated electron system and selected from the group consisting of the thiophenes, furans, pyrans, chromenes, pyrroles, pyridines, pyrazines, pyrimidines, pyridazines, indolidines, perimidines, thiazoles, imidazoles, oxazoles, 1,3,5-triazines and the oxazines; and the substituted derivatives thereof, said substituents being selected from the group consisting of halogen atoms, alkyl groups, alkenyl groups, alkoxy groups, aryl groups, aryloxy groups, carbonyl groups, sulfonyl groups, carboxyl groups, alkoxycarbonyl groups, carbamyl groups, sulfone groups, sulfamyl groups, acylamino groups, ureido groups, sulfonamido groups, amino groups, nitro groups, cyano groups and hydroxyl groups; (4) a condensed aromatic ring having the formula

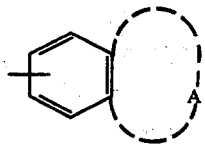

wherein A represents the atoms necessary to form an aromatic condensed ring system; (5) a

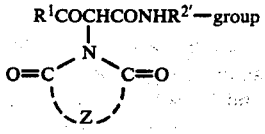

wherein $R^{2'}$ represents (a) the divalent moiety of said monovalent phenyl group, (b) the divalent moiety of said monovalent substituted phenyl group, (c) the divalent moiety of two of said monovalent phenyl groups bonded together, (d) the divalent moiety of two of said monovalent phenyl groups or two of said monovalent substituted phenyl groups bonded together through a divalent substituent selected from the group consisting of $—CH_2—$, —O— and —NHCONH—, (e) the divalent moiety of said monovalent heterocyclic group, (f) the divalent moiety of two of said monovalent heterocyclic groups bonded together or (g) the divalent moiety of two of said monovalent heterocyclic groups of two of said monovalent substituted heterocyclic groups bonded together through a divalent substituent selected from the group consisting of $—CH_2—$, —O— and —NHCONH—, and wherein Z represents the non-metallic atoms necessary, when combined with the

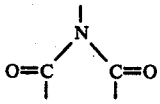

moiety in general formula, to form a 5-membered or 6-membered substituted or unsubstituted ring, wherein the substituent of said substituted ring is a monovalent group selected from the group consisting of a halogen atom, an alkyl group, an alkoxy group, an aryl group, an aryloxy group, a sulfone group, a carboxyl group and a divalent group which forms a 5- or 6-membered ring together with the two adjacent carbon atoms in said 5- or 6-membered ring.

37. The method of claim 34, wherein said $R^1$ has from 1 to 32 carbon atoms.

38. The method of claim 34, wherein said $R^1$ is selected from the group consisting of methyl, ethyl, n-propyl, isopropyl, n-butyl, isobutyl, tert-butyl, n-amyl, isoamyl, tert-amyl, n-hexyl, 1-methylpentyl, 2-methylpentyl, 5-methylpentyl, neopentyl, 1,1-dimethylbutyl, n-heptyl, 1-methylhexyl, 2-methylhexyl, 3-methylhexyl, 5-methylhexyl, 1,1-dimethylhexyl, n-octyl, 2-ethyhexyl, 1,1-dimethylhexyl, n-nonyl, isononyl, n-decyl, n-undecyl, n-dodecyl, n-tetradecyl, n-octadecyl, 1,1-dimethylnonyldecyl, 1,1-di-n-amylhexyl-1-methyl-1-nonyldecyl, cyclopropyl, cyclobutyl, cyclopentyl, cyclohexyl, benzyl, phenethyl, allyl, oleyl, 7,7-dimethylnorbornyl, 1-methylcyclohexyl, p-tert-butylphenoxy-dimethylmethyl, a-methyoxyisopropyl, chloro-t-butyl, cinnamyl and 2-furyl groups.

39. The method of claim 34, wherein said $R^1$ is a tert-butyl group.

40. The method of claim 34, wherein said coupler has the general formula

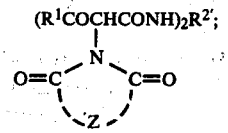

wherein $R^1$ represents an alkyl, an alkenyl, a cycloalkyl, an aralkyl, an alkylcycloalkyl, an aryloxyalkyl, an alkoxyalkyl, a haloalkyl, a furyl or a norbornyl group, wherein $R^{2'}$ represents (a) a divalent phenyl group, (b) a divalent substituted phenyl group, wherein said substituents are halogen atoms, alkyl groups, alkenyl groups, alkoxy groups, aryl groups, aryloxy groups, carbonyl groups, sulfonyl groups, carboxyl groups, alkoxy carbonyl groups, carbamyl groups, sulfone groups sulfamyl groups, acylamino groups, ureido groups, sulfonamide groups, amino groups, nitro groups, cyano groups and hydroxyl groups; (c) a divalent heterocyclic group bound through carbon atoms in said heterocyclic group which are part of a conjugated electron system and selected from the group consisting of the thiophenes, furans, pyrans, chromenes, pyrroles, pyridines, pyrazines, pyrimidines, pyridazines, indolidines, perimidines, thiazoles, imidazoles, oxazoles, 1,3,5-triazines and the oxazines; and the substituted derivatives thereof, said substituents being selected from the group consisting of halogen atoms, alkyl groups, alkenyl groups, alkoxy groups, aryl groups, aryloxy groups, carbonyl groups, sulfonyl groups, carboxyl groups, alkoxycarbonyl groups, carbamyl groups, sulfone groups, sulfamyl groups, acylamino groups, ureido groups, sulfonamide groups, amino groups, nitro groups, cyano groups and hydroxyl groups; (d) the divalent moiety of two of said divalent phenyl or substituted phenyl groups bonded together; (e) the divalent moiety of two of said divalent phenyl groups or two of said divalent substituted phenyl groups bonded together through a divalent substituent selected from the group consisting of $—CH_2—$, —O— and —NHCONH—, (f) the divalent moiety of two of said divalent heterocyclic or substituted heterocyclic groups bonded together, (g) the divalent moiety of two of said divalent heterocyclic groups or two of said divalent substituted heterocyclic groups bonded together through a divalent substituent selected from the group consisting of $—CH_2—$, —O— and —NHCONH—; and wherein Z represents the non-metallic atoms necessary, when combined with the

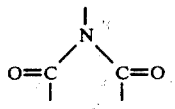

moiety in general formula, to form a 5-membered or 6-membered substituted or unsubstituted ring, wherein the substituent of said substituted ring is a monovalent group selected from the group consisting of a halogen atom, an alkyl group, an alkoxy group, an aryl group, an aryloxy group, a sulfone group, a carboxyl group and a divalent group which forms a 5- or 6-membered ring together with the two adjacent carbon atoms in said 5- or 6-membered ring.

41. The method of claim 34, wherein $R^2$ is a substituted phenyl group, said substituent being located in the ortho position with respect to the residual group

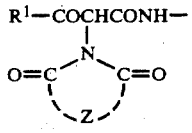

and being selected from the group consisting of a halogen atom, an alkoxy group, an aryloxy group, an alkyl group and an N,N-dialkyl amino group.

42. The method of claim 41, wherein said $R^1$ is a tert-butyl group.

43. Th method of claim 34, wherein said Z is selected from the group consisting of:

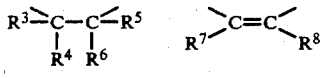

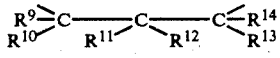

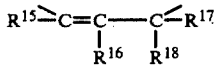

and

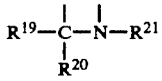

wherein $R^3$, $R^4$, $R^5$, $R^6$, $R^7$, $R^8$, $R^9$, $R^{10}$, $R^{11}$, $R^{12}$, $R^{13}$, $R^{14}$, $R^{15}$, $R^{16}$, $R^{17}$ and $R^{18}$ are each a hydrogen atom, a halogen atom, an alkyl group, an alkoxy group, an aryl group, an aryloxy group, a sulfone group, or a carboxyl group, wherein $R^3$ and $R^5$, $R^7$ and $R^8$, $R^9$ and $R^{11}$, $R^{12}$ and $R^{13}$, $R^{15}$ and $R^{16}$ and $R^{16}$ and $R^{17}$ may be combined together to form a saturated or unsaturated 5-membered or 6-membered ring, wherein $R^{19}$, $R^{20}$ and $R^{21}$ each represents a hydrogen atom, an alkyl group or an aryl group.

44. The method of claim 43, wherein said $R^1$ is a tert-butyl group.

45. The method of claim 34, wherein said $R^1$ is a tertiary alkyl group having from 4 to about 32 carbon atoms.

46. The method of claim 34, wherein said coupler has the general formula

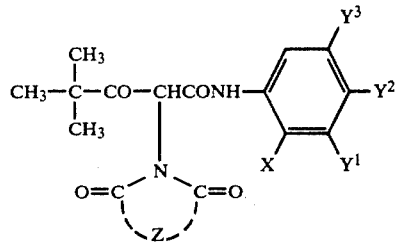

wherein Z is as defined in claim 34 and X is a halogen atom, an alkoxy group, an aryloxy group, or a tertiary amino group, and $Y^1$, $Y^2$ and $Y^3$, which may be the same or different, are each selected from the group consisting of hydrogen atoms, halogen atoms, alkyl groups, alkenyl groups, alkoxy groups, aryl groups, aryloxy groups, carbonyl groups, sulfonyl groups, carboxyl groups, alkoxycarbonyl groups, carbamyl groups, sulfone groups, sulfamyl groups, acylamino groups, ureido groups, sulfonamide groups, amino groups, nitro groups, and cyano groups.

47. The method of claim 46, wherein said Z is selected from the group consisting of:

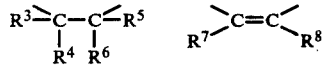

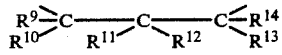

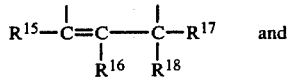

and

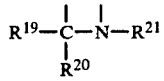

wherein $R^3$, $R^4$, $R^5$, $R^6$, $R^7$, $R^8$, $R^9$, $R^{10}$, $R^{11}$, $R^{12}$, $R^{13}$, $R^{14}$, $R^{15}$, $R^{16}$, $R^{17}$ and $R^{18}$ are each a hydrogen atom, a halogen atom, an alkyl group, an alkoxy group, an aryl group, an aryloxy group, a sulfone group, or a carboxyl group, wherein $R^3$ and $R^5$, $R^7$ and $R^8$, $R^9$ and $R^{11}$, $R^{12}$ and $R^{13}$, $R^{15}$ and $R^{16}$ and $R^{16}$ and $R^{17}$ may be combined together to form a saturated or unsaturated 5-membered or 6-membered ring, wherein $R^{19}$, $R^{20}$ and $R^{21}$ each represents a hydrogen atom, an alkyl group or an aryl group.

* * * * *